US008683822B2

(12) United States Patent
Kang et al.

(10) Patent No.: US 8,683,822 B2
(45) Date of Patent: Apr. 1, 2014

(54) ICE-MAKING ASSEMBLY AND REFRIGERATOR USING THE SAME

(75) Inventors: Byeong-Gyu Kang, Changwon (KR); Young-Woo Kim, Changwon (KR); Jae-Youl Lee, Changwon (KR); Hwal-Kyun Lee, Changwon (KR); Jong-Seok Yoon, Changwon (KR); Sang-Ho Park, Changwon (KR)

(73) Assignee: LG Electronics Inc., Seoul (KR)

( * ) Notice: Subject to any disclaimer, the term of this patent is extended or adjusted under 35 U.S.C. 154(b) by 958 days.

(21) Appl. No.: 12/375,914

(22) PCT Filed: Aug. 16, 2007

(86) PCT No.: PCT/KR2007/003924

§ 371 (c)(1),
(2), (4) Date: Feb. 26, 2010

(87) PCT Pub. No.: WO2008/020723

PCT Pub. Date: Feb. 21, 2008

(65) Prior Publication Data

US 2010/0147011 A1 Jun. 17, 2010

(30) Foreign Application Priority Data

| | | |
|---|---|---|
| Aug. 17, 2006 | (KR) | 10-2006-0077562 |
| Aug. 17, 2006 | (KR) | 10-2006-0077565 |
| Aug. 17, 2006 | (KR) | 10-2006-0077569 |
| Aug. 21, 2006 | (KR) | 10-2006-0078557 |
| Aug. 21, 2006 | (KR) | 10-2006-0078558 |
| Aug. 21, 2006 | (KR) | 10-2006-0078559 |
| Aug. 21, 2006 | (KR) | 10-2006-0078560 |
| Aug. 21, 2006 | (KR) | 10-2006-0078561 |

(51) Int. Cl.
*F25C 5/18* (2006.01)
*F25D 23/04* (2006.01)
*F25D 23/08* (2006.01)

(52) U.S. Cl.
USPC ..... 62/344

(58) Field of Classification Search
CPC ..... F25C 5/182; F25C 5/185
USPC ..... 62/344, 302
See application file for complete search history.

(56) References Cited

U.S. PATENT DOCUMENTS 2,656,688 A * 10/1953 Hinkel ..... 62/441
3,146,601 A * 9/1964 Gould ..... 62/3.6

(Continued)

FOREIGN PATENT DOCUMENTS

JP 11304323 A * 11/1999
JP 2004-101029 A 4/2004

(Continued)

OTHER PUBLICATIONS

Korean language abstract only for KR-10-0281838-B1.

(Continued)

*Primary Examiner* — Ljiljana Ciric
*Assistant Examiner* — Alexis Cox
(74) *Attorney, Agent, or Firm* — Birch, Stewart, Kolasch & Birch, LLP

(57) ABSTRACT

A refrigerator includes a freezing chamber door provided with an ice-making assembly. Ice made by the ice-making assembly can be immediately drawn out to the outside by opening an exclusively used home-bar door. In addition, an ice-making case is coupled by a coupling formed integrally with the freezing chamber door and the ice-making case without a coupling tool or operation. Moreover, if a water bucket is installed to the ice-making case, a water supply hole of the lower end of the water bucket is opened by an opening and closing structure, so that water in the water bucket is automatically supplied to an ice tray. In addition, an ice-separating lever having a ⊂ shape is provided to simultaneously rotate a plurality of ice trays. Meanwhile, an ice bank cooperates with the home-bar door to be drawn out forward as the home-bar door is opened.

13 Claims, 29 Drawing Sheets

(56) References Cited

U.S. PATENT DOCUMENTS

| | | | | |
|---|---|---|---|---|
| 3,411,569 | A * | 11/1968 | Hildreth | 165/63 |
| 4,095,439 | A * | 6/1978 | Linstromberg | 62/344 |
| 4,139,249 | A * | 2/1979 | Hillman | 312/333 |
| 4,368,622 | A * | 1/1983 | Brooks | 62/157 |
| 4,416,477 | A * | 11/1983 | Bialobrzeski et al. | 292/19 |
| 5,012,655 | A | 5/1991 | Chatterton | |
| 5,555,743 | A * | 9/1996 | Hatanaka | 62/347 |
| 6,050,097 | A | 4/2000 | Nelson et al. | |
| 6,442,954 | B1 | 9/2002 | Shapiro et al. | |
| 7,469,553 | B2 * | 12/2008 | Wu et al. | 62/344 |
| 7,810,344 | B2 * | 10/2010 | Yoon et al. | 62/338 |
| 2006/0086128 | A1 * | 4/2006 | Maglinger et al. | 62/344 |
| 2009/0229284 | A1 * | 9/2009 | Fulton | 62/137 |
| 2010/0281908 | A1 * | 11/2010 | Kim | 62/344 |
| 2011/0232317 | A1 * | 9/2011 | Flores | 62/320 |
| 2011/0239687 | A1 * | 10/2011 | Lim et al. | 62/344 |

FOREIGN PATENT DOCUMENTS

| | | | |
|---|---|---|---|
| JP | 2006-170545 | A | 6/2006 |
| KR | 10-2005-0110213 | A | 11/2005 |
| KR | 10-0539562 | B1 | 12/2005 |
| WO | WO 2005/026631 | A1 | 3/2005 |

OTHER PUBLICATIONS

Abstract only for KR-10-2000-0032980-A.

* cited by examiner

ICE-MAKING ASSEMBLY AND REFRIGERATOR USING THE SAME

TECHNICAL FIELD

The present invention relates to a refrigerator, and more particularly, to an ice-making assembly for a refrigerator that makes and stores ice in a refrigerator.

BACKGROUND ART

Generally, a refrigerator, which is a device for the cold storage of food, stores food by freezing or refrigerating it in accordance with a state of food to be stored.

Cold air supplied into a refrigerator is produced by the heat-exchange with a refrigerant and is continuously supplied into the refrigerator while a cycle of compression-condensation-expansion-evaporation is repeatedly performed. The supplied refrigerant is uniformly distributed into the refrigerator by convection, so that it is possible to store food in the refrigerator at a desired temperature.

FIGS. 1 and 2 are perspective views illustrating an example of the outside of a conventional side-by-side refrigerator and the inside of a freezing chamber thereof.

As shown in the figures, the inner right side of a refrigerator main body is provided with a refrigerating chamber, and the inner left side thereof is provided with a freezing chamber. Furthermore, the refrigerating and freezing chambers are selectively opened and closed by refrigerating and freezing chamber doors 10 and 12, respectively.

In addition, the front side of the freezing chamber door 12 is provided with a dispenser 14 that enables ice and water stored in the refrigerator to be directly taken out from the outside.

Meanwhile, the inner upper end of the freezing chamber is provided with an ice maker 20, and an ice bank 22 in which ice made in the ice maker 20 is stored is installed below the ice maker 20.

An ice chute 24 for guiding the ice stored in the ice bank 22 is formed on the rear side of the freezing chamber door 12. Hence, the ice stored in the ice bank 22 is guided to the dispenser 14 through the ice chute 24 and is drawn out to the outside.

In addition, a water bucket 26 for temporarily storing water to supply water to the ice maker 20 is positioned above the ice maker 20.

However, in such a prior art, there is a problem in that the ice maker 20 and the ice bank 22 are provided in the freezing chamber, and thus, a freezing space in the freezing chamber is relatively small.

Furthermore, according to the prior art, loss of cold air is great because the freezing chamber door should be opened when taking out ice from the ice bank.

DISCLOSURE

Technical Problem

The present invention is conceived to solve the aforementioned problems in the prior art. An object of the present invention is to provide an ice-making assembly for a refrigerator wherein an ice-making chamber for making and storing ice is formed on a freezing chamber door and an ice bank can be drawn out without opening the freezing chamber door.

Another object of the present invention is to provide an ice-making assembly for a refrigerator in which a water bucket is guided to be installed and then prevented from freely moving after the installation, and the water in the water bucket is automatically introduced into an ice tray simultaneously when the installation of the water bucket.

A further object of the present invention is to provide an ice-making assembly for a refrigerator that is provided with an ice-separating lever for simultaneously rotating a plurality of ice trays.

A still further object of the present invention is to provide a refrigerator in which an ice bank is drawn out to the outside simultaneously when opening a home-bar door or slid and drawn out in a one-touch manner.

Technical Solution

According to an aspect of the present invention for achieving the objects, there is provided an ice-making assembly for a refrigerator, comprising: an ice-making case provided on a back side of a freezing chamber door and defining an external appearance; an ice-making chamber formed in the ice-making case to make ice; a water bucket provided above the ice-making chamber and storing water in an inner space thereof; and an ice bank provided below the ice-making chamber, storing ice made in the ice-making chamber, and being selectively closed by a home-bar door provided on the freezing chamber door.

The ice-making assembly further comprise a front mounting unit allowing one side of the ice-making case to be caught to the back side of the freezing chamber door and a side mounting unit allowing a lateral side of the ice-making case to be caught to an inside of an edge of the freezing chamber door so that the ice-making case is caught and fixed to the back side of the freezing chamber door.

The ice-making assembly further comprises an installation guide means for guiding the water bucket to be readily placed on the ice-making case, wherein the installation guide means comprises an installation guide and a guide protrusion respectively formed on the ice-making case and the water bucket in correspondence to each other to be coupled to each other.

And the installation guide comprises a protrusion receiving part which the guide protrusion is inserted into and received in, and a protrusion guide part guiding the guide protrusion to the protrusion receiving part and having a shape of 'V' in which a distance between both ends thereof is gradually increased as it goes in one direction.

The ice-making assembly further comprises a separation preventing means for preventing the water bucket installed to the ice-making case from escaping, wherein the separation preventing means comprises a separation preventing projection and a catching rib respectively formed to have shapes corresponding to each other on the ice-making case and the water bucket and interfering with each other.

And the water bucket further comprises water supply holes bored through a bottom of the water bucket and to guide water to flow downward, and an opening and closing means for selectively opening and closing the water supply holes, the opening and closing means opening the water supply holes when the water bucket is installed to the ice-making case.

The opening and closing means comprises an interference lever formed to protrude inwardly from the ice-making case, and an opening and closing lever formed integrally with the water bucket and having one end selectively contacted with the interference lever and the other end selectively opening the water supply holes.

The opening and closing lever comprises a lever body formed integrally with the water bucket, a contact rib formed to extend from a central portion of the lever body in one direction to allow an end of the contact rib to be selectively contacted with the interference lever, an opening and closing rib formed to extend from the left and right side ends of the lever body in one direction and passing through and inserted into the water supply holes, and opening and closing plugs formed on ends of the opening and closing ribs to selectively close the water supply holes.

And the ice-making chamber comprises an ice tray in which water is frozen, a tray gear provided on one side of the ice tray, an ice-separating lever for transmitting rotational force to the tray gear, and a return member applying rotational force in one direction so that the ice tray returns to its original location.

The ice-separating lever is formed in the shape of 'ㄷ', and an end of the ice-separating lever is fixedly coupled to the tray gear.

One or more ice trays and tray gears are further provided, and each pair of the ice trays and tray gears rotates about the same rotating shaft.

A connection gear for connecting the respective tray gears is further provided between the plurality of tray gears, and the ice-separating lever is connected to any one of the plurality of tray gears.

The ice bank cooperates with the home-bar door, thereby being drawn out forward as the home-bar door is opened.

According to another aspect of the present invention, there is provided an ice-making assembly for a refrigerator, which comprise an ice-making case provided on a back side of a freezing chamber door and defining an external appearance; an ice-making chamber formed in the ice-making case and provided with a plurality of ice trays to make ice; a water bucket provided above the ice-making chamber and having a plurality of water supply holes vertically bored through a lower end of the water bucket, the plurality of water supply holes allowing water to be supplied to the plurality of ice trays therethrough; and an ice bank provided below the ice-making chamber, storing ice made in the ice-making chamber, and being drawn out forward through a home-bar door provided on the freezing chamber door, wherein a water storage space in the water bucket corresponds in size to storage spaces in the ice trays.

The plurality of ice trays are arranged to be spaced apart vertically and in a fore and aft direction by a certain distance and are individually supplied with water from the water bucket through the plurality of water supply holes.

The plurality of ice trays comprises an upper tray arranged in an upper portion and a lower tray arranged in a lower portion, and a water supply pipe for guiding water guided through one of the water supply hole of the water bucket to the lower tray is further provided below the water bucket vertically.

According to the other aspect of the present invention, there is provided a refrigerator which comprise: a freezing chamber door for selectively opening and closing a freezing chamber; an ice-making assembly provided on a back side of the freezing chamber door and comprising a water bucket for storing water, an ice-making chamber provided below the water bucket to make ice, an ice bank provided below the ice-making chamber to store ice; and a bank supporting plate provided below the ice bank to support the ice bank; and a home-bar door provided on the freezing chamber door and selectively opened so that a front of the ice bank is exposed to the outside, wherein the ice bank is allowed to be drawn out to the outside through the home-bar door.

The ice bank cooperates with the home-bar door, thereby being drawn out forward as the home-bar door is opened.

The rear side of the home-bar door is further provided with a connection link connecting the bank supporting plate and the home-bar door to each other, whereby the connection link cooperates with the home-bar door to cause the bank supporting plate and the ice bank to be moved as the home-bar door rotates.

And the refrigerator further comprise a movement enforcement means forcibly causing the bank supporting plate to move forward, and a locking means causing the bank supporting plate to be selectively fixed to a rear end of the ice-making case.

The damping means for controlling a moving velocity of the bank supporting plate is further provided in one side of the movement enforcement means.

The damping means comprises a rack and a pinion respectively formed on the ice-making case and the bank supporting plate in correspondence to each other to be meshed with each other.

The movement enforcement means comprises a scroll spring and a spring roll around which the scroll spring is wounded.

The locking means comprises a button assembly and a button hook respectively formed on the ice-making case and the bank supporting plate in correspondence to each other to be selectively coupled to each other.

The button assembly and the button hook are configured so that they are repeatedly coupled and released sequentially by an external force applied from one side of the bank supporting plate.

The button assembly comprises a button case defining an external appearance, a button body sliding within the button case forward and rearward, and a coupling hook formed integrally with the button body and having an end selectively coupled to the button hook.

According to another aspect of the present invention, there is provided a refrigerator which comprise a freezing chamber for storing goods in a frozen state; a freezing chamber door for selectively opening and closing one side of the freezing chamber; an ice-making chamber provided in one side of the freezing chamber, making ice by freezing water and storing the ice, and having an ice-separating lever for separating ice of an ice tray; and a home-bar door rotatably installed to the freezing chamber door and having a size corresponding to a front size of the ice-making chamber, wherein the ice-separating lever is exposed to the outside when the home-bar door is open.

The ice-making chamber comprises an ice maker, a water bucket provided on one side of the ice maker and supplying water to the ice-making chamber, and an ice bank provided on one side of the ice-making chamber and storing ice supplied from the ice-making chamber.

The ice maker comprises a plurality of ice trays in which ice is made, a plurality of ice-separating gears fixedly installed to one ends of the plurality of ice trays to transmit a rotational force to the ice trays, a driving gear provided between the plurality of ice-separating gears to transmit a rotational force to the ice-separating gears, and an ice-separating lever coupled to the driving gear and forcibly causing the driving gear to rotate.

The ice-separating gear and the driving gear have gear teeth corresponding in shape to each other formed on their outer circumference surfaces to be meshed with each other.

The ice bank is provided below the ice-making chamber to store ice separated from the ice trays, the ice bank being installed to be drawn in and out forward.

Advantageous Effects

According to the present invention as described in detail above, an ice-making assembly is provided on a freezing chamber door. That is, the ice-making assembly is not installed to a freezing chamber main body but on the back side of the freezing chamber door. Hence, there is an advantage in that a space of the freezing chamber is more effectively utilized in comparison with a case where the ice-making assembly is provided on the freezing chamber main body as in a prior art.

Furthermore, according to the present invention, a home-bar door for taking out ice is additionally provided on the freezing chamber door of the refrigerator. That is, the freezing chamber door is provided with the ice-making assembly, and the ice made by the ice-making assembly can be allowed to be immediately taken out to the outside by opening the exclusively used home-bar door. Hence, according to the present invention, there is an advantage in that the loss of cold air can be prevented because it is not necessary to open the freezing chamber door in order to take out the ice from the freezing chamber. That is, it is advantageous to relatively prevent the loss of cold air because it is possible to take out ice only by opening the home-bar door.

Moreover, according to the present invention, an ice-making case is coupled by means of a coupling means formed integrally with the freezing chamber door and the ice-making case without a coupling tool or coupling operation. Hence, there is an advantage in that because a coupling member or coupling operation for installing the ice-making case is not necessary, the cost is reduced and the operation efficiency is improved.

Meanwhile, in the present invention, when a water bucket for storing water is installed, an installation guide means for guiding the installation position thereof is further provided. Hence, there is an advantage in that the water bucket can be easily installed. That is, it is effective that if only a user takes the water bucket down from above the ice-making case without setting the exact installation position of the water bucket, the installation of the water bucket is completed.

Further, according to the present invention, there is further provided a separation preventing means for preventing the installed water bucket from being separated. Hence, there is an advantageous in that it can be prevented that the installed water bucket is separated and detached itself by external or internal force.

According to the present invention, if the water bucket is installed to the ice-making case, a water supply hole of the lower end of the water bucket is opened by an opening and closing means, so that water in the water bucket is automatically supplied to an ice tray. Hence, according to the present invention, there is an advantage in that convenience of use is increased and operation efficiency is improved because it is not necessary for the user to take separate action for supplying the ice tray with the water in the water bucket.

Furthermore, according to the present invention, a storage space in the water bucket and a storage space in the ice tray are configured to correspond in size to each other. Hence, since when water is supplied from the water bucket to the ice tray, the ice tray can be prevented from overflowing, there is an advantage in that it is possible to previously prevent the failure due to freezing of the surroundings or contamination inside of the freezing chamber.

According to the present invention, the ice-making assembly is provided with a '⊂'-shaped ice-separating lever to simultaneously rotate the plurality of ice trays. Hence, there is an advantage in that ice provided in the plurality of ice trays is readily separated, and thus the operation efficiency is improved.

Furthermore, according to the present invention, the rear side of the ice-making case (tray case) is formed of a transparent material, so that a user can perform ice-separating operation while viewing the state thereof with the eye. Hence, there is an advantage in that damage of the product due to failure can be prevented because it is possible to immediately check a normal operation state of the product, such as return operation of the ice tray to its original position, as well as the operation or not of the ice tray and a separation state of ice.

Meanwhile, according to the present invention, an ice bank cooperates with the home-bar door so that the ice bank is drawn out forward when the home-bar door is opened. Hence, there is an advantage in that a separate drawing-out action of the ice bank is not necessary and thus it is easy to use. There is also an advantage in that time for opening the home-bar door to take out ice is relatively reduced, and thus, the electric power consumption is generally saved.

According to the present invention, the user can use ice stored in the ice bank by opening the home-bar door and drawing out the ice bank forward when necessary, so that there is an advantage in that it is possible to use ice while reducing outflow of cold air.

Furthermore, according to the present invention, it is also possible to separate the ice bank by drawing out it rearward in a state where the freezing chamber door is open. Hence, there is an advantage in that post management such as assembly of the ice-making assembly or after-sale service for the inside of the ice-making assembly is convenient, and thus, the operation efficiency is improved.

Meanwhile, in the present invention, it is possible to draw out the ice bank to the outside in a one-touch manner. That is, a user draws out the ice bank forward only by pushing a bank supporting plate, which supports the ice bank, rearward. Hence, there is an advantage in that the convenience of use is improved.

According to the present invention, the water bucket, an ice maker and the ice bank in an ice-making chamber are configured so that they can be drawn out forward by a guide means. Hence, there is an advantage in that the convenience of use is increased because it is possible to immediately draw out the respective parts in the ice-making chamber to the outside after opening the home-bar door.

In addition, the front side of the ice maker is formed of a transparent material, and all the plurality of ice trays are rotated only by operating the single ice-separating lever. Hence, because the ice in the plurality of ice-separating trays can fall into the ice bank by operating the ice-separating lever once after opening the home-bar door and immediately checking whether ice is made, the advantageous effect of the improved operation efficiency can be expected.

BEST MODE

Hereinafter, a first embodiment of a refrigerator according to the present invention will be described in detail.

Although not shown, a freezing chamber and a refrigerating chamber are generally formed in a refrigerator main body, and the freezing chamber and the refrigerating chamber are selectively opened and closed by means of a freezing chamber door and a refrigerating chamber door, respectively.

In addition, the freezing chamber door is generally configured such that it is opened and closed to pivot on a left or right hinge in the left-and-right direction or on its lower end in the up-and-down direction. In the present invention, a refrigerator with a door opened and closed in the left-and-right direction will be described as an example.

Figure 1:
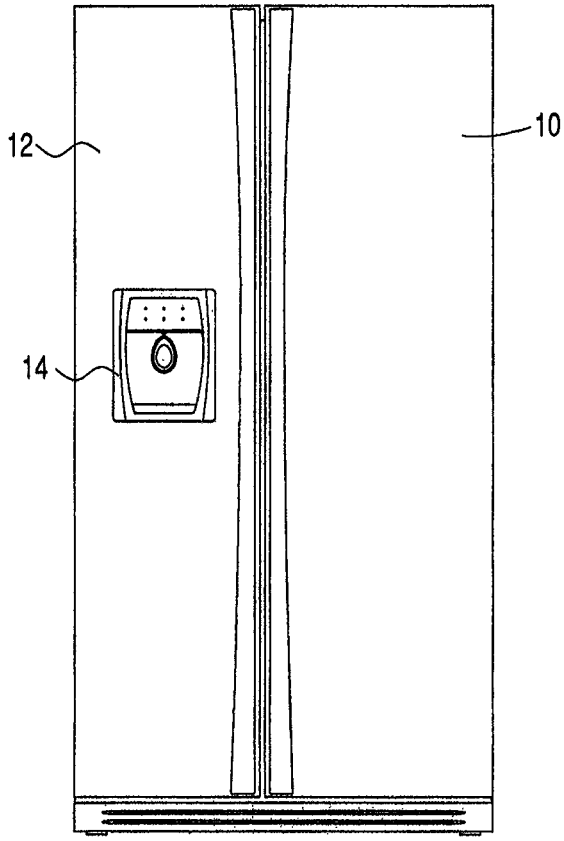
FIG. 1 is a front view illustrating an external appearance of a refrigerator according to a prior art.
Figure 2:
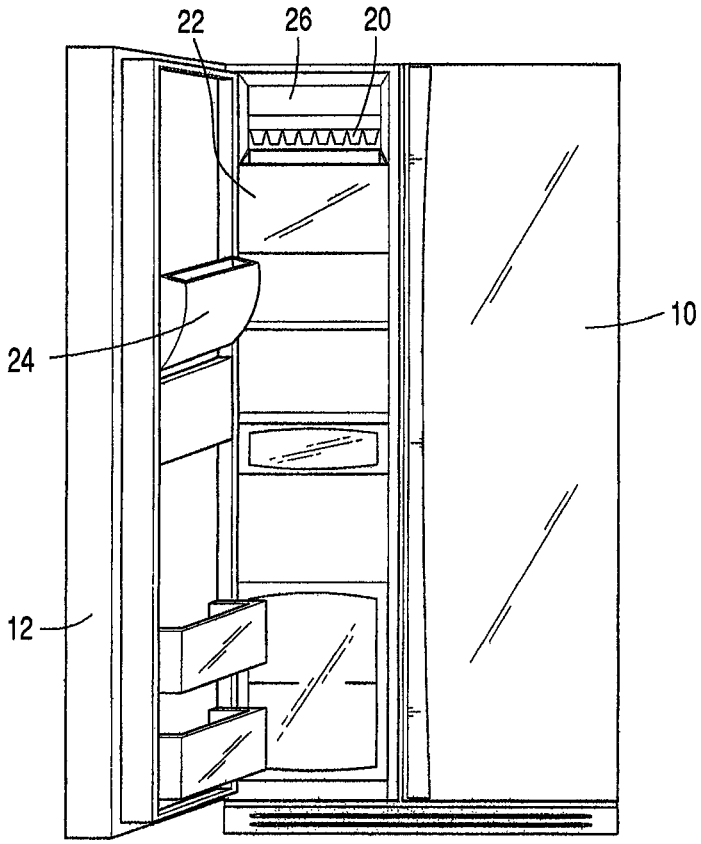
FIG. 2 is a view illustrating a use state of an inside of a freezing chamber of the refrigerator according to a prior art.
Figure 3:
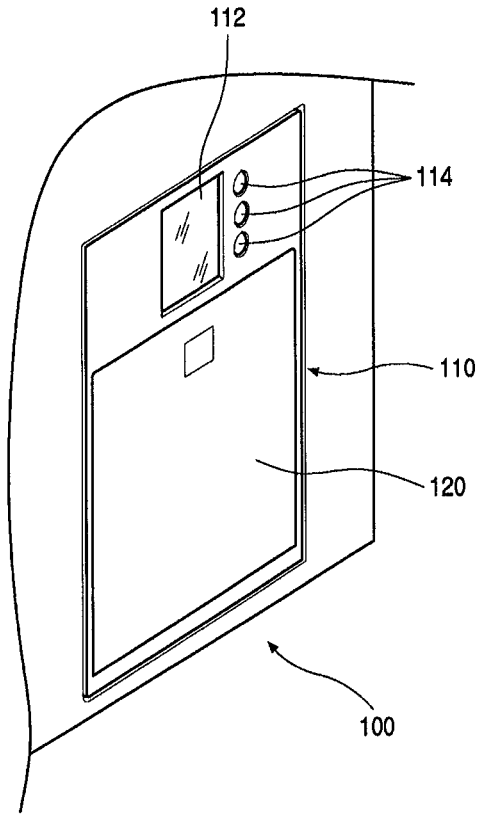
FIG. 3 is a front perspective view of a freezing chamber door to which a first embodiment of an ice-making assembly for a refrigerator according to the present invention is installed.
Figure 4:
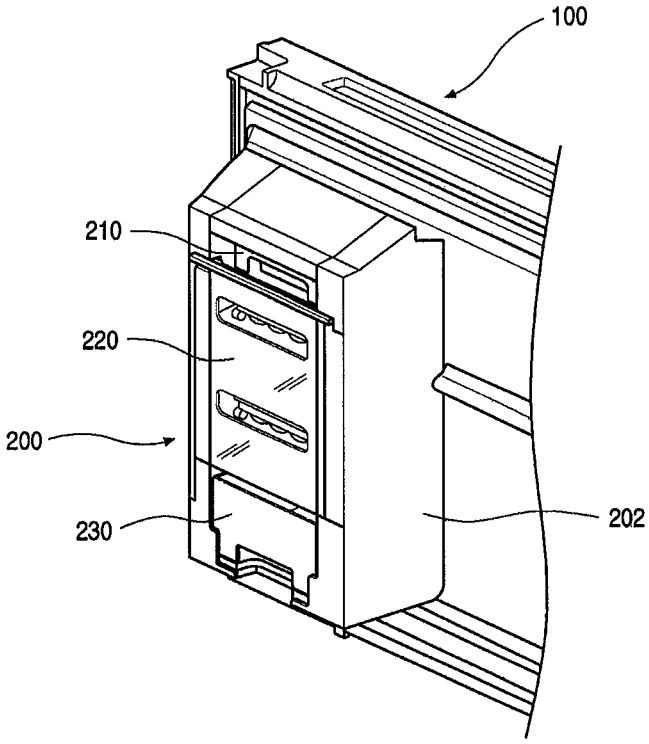
FIG. 4 is a rear perspective view of the freezing chamber door to which the first embodiment of the present invention is installed.

FIGS. 3 and 4 respectively illustrate front and rear perspective views of a freezing chamber door to which an ice-making assembly for a refrigerator according to the present invention is installed.

First, FIG. 3 partially illustrates a front external appearance of a freezing chamber door 100 for selectively opening and closing a freezing chamber.

As shown in the figure, a home-bar panel 110 is provided on the front side of the freezing chamber door 100. The home-bar panel 110 is formed in the shape of a quadrangular flat plate and defines the front external appearance of the freezing chamber door 100. The home-bar panel 110 is a home-bar panel of the freezing chamber that is discriminated from a generally installed home-bar and a home-bar panel of a refrigerating chamber.

The home-bar panel 110 is provided with a home-bar door 120. The home-bar door 120 is formed on a lower half portion of the home-bar panel 110 and is the exclusively used home-bar door 120 for drawing out an ice bank 230, which will be described later, to the outside (the front). That is, a general home-bar door is installed to a refrigerating chamber door and is to conveniently draw out a beverage and so forth stored in a refrigerating chamber to the outside without opening the refrigerating chamber door, whereas the home-bar door 120 of the present invention is a home-bar door exclusively used for an ice bank for drawing out ice made in an ice-making chamber of the freezing chamber.

An upper half portion of the home-bar panel 110 is respectively provided with a display 112 and a plurality of operation buttons 114. The display 112 is a part that displays an operating state of an ice-making assembly 200, which will be described below, or an operating state of the freezing chamber to the outside. Furthermore, the operation buttons 114 are to enable a user to operate or set the ice-making assembly 200 from the outside.

The home-bar door 120 is installed such that it is opened forward (rightward in FIG. 5) about its lower end. Thus, a door hinge 122 is provided on the lower end of the home-bar door 120 and is the center of the rotation of the home-bar door 120.

Figure 12:
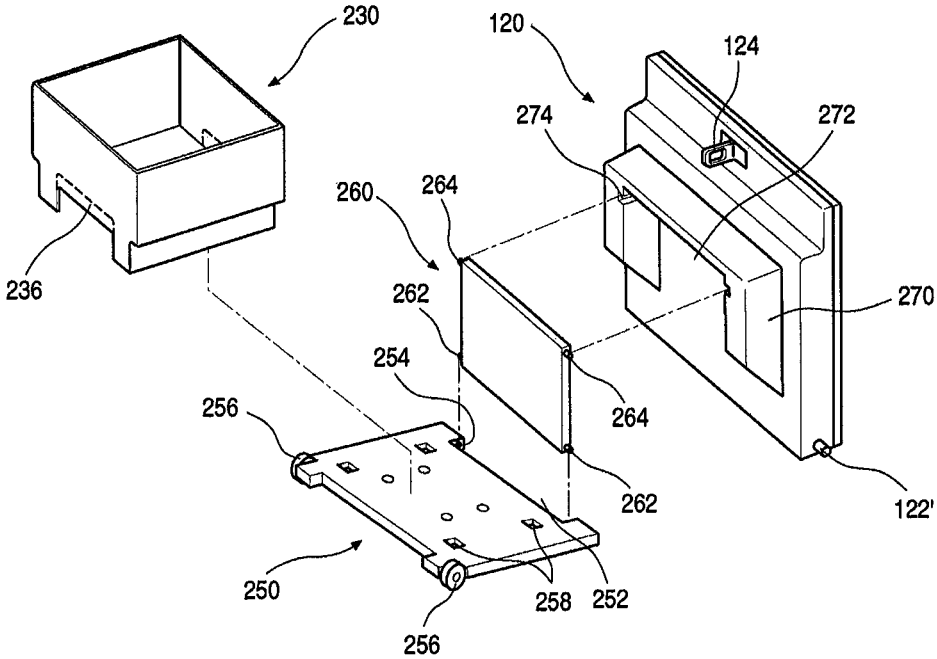
FIG. 12 is an exploded perspective view illustrating a home-bar door and an ice bank of the first embodiment of the present invention.

The rear side (the left side in FIG. 5) of the upper end of the home-bar door 120 has a coupling hook 124 installed thereto (see FIG. 12). The coupling hook 124 is a device for maintaining a state where the home-bar door 120 is closed in the freezing chamber door 100. Hence, the freezing chamber door 100 is provided with a hook fixture 126 to which the coupling hook 124 is selectively caught and fixed.

FIG. 4 illustrates the rear of the freezing chamber door 100.

As shown in the figure, the back side of the freezing chamber door 100 is provided with the ice-making assembly 200 that makes and stores ice.

The ice-making assembly 200 includes a water bucket 210 for storing water, an ice-making chamber 220 provided below the water bucket 210 to make ice, an ice bank 230 provided below the ice-making chamber 220 to stores ice.

More specifically, an ice-making case 202 in the shape of a quadrangular box defines an external appearance of the ice-making assembly 200 in outline, and the rear (the front in FIG. 4) of the ice-making case 202 is opened. Furthermore, the ice-making chamber 220 in which ice is made is formed on the central portion of the ice-making case 202.

The ice-making chamber 220 is provided with a plurality of ice trays 224, which will be described below, and the water bucket 210 for supplying water to the ice trays 224 is installed above the ice-making chamber 220. In addition, the ice bank 230 that temporarily stores ice made in the ice-making chamber 220 is provided below the ice-making chamber 220.

Figure 5:
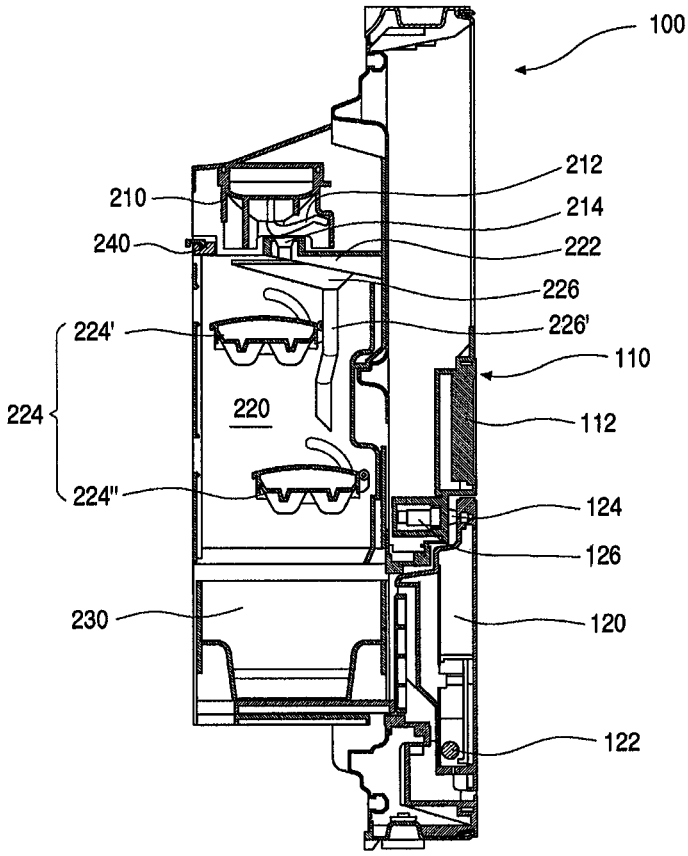
FIG. 5 is a side sectional view showing an installation state of the first embodiment of the present invention.

FIG. 5 is a side sectional view illustrating a state where the ice-making assembly 200 is installed to the back side of the freezing chamber door 100.

As shown in the figure, an opening and closing lever 212 for controlling water stored in the water bucket 210 to cause the water to selectively drop downwardly is provided inside of the water bucket 210. That is, the opening and closing lever 212 selectively opens and closes water supply holes 214, which are vertically bored through the bottom of the water bucket 210 and enable water in the water bucket 210 to selectively drop downwardly and to flow be introduced into the ice-making chamber 220.

The ice-making chamber 220 is further provided with an interference lever 222. The interference lever 222 is installed such that its end interferes with one end of the opening and closing lever 212. Hence, in a case where the water bucket 210 is installed, the end of the interference lever 222 pushes up the opening and closing lever 212, so that the water supply holes 214 are opened.

The ice-making chamber 220 is provided with the ice trays 224 that is a case in which ice is made. More specifically, the ice trays 224 are provided in two and include the upper tray 224' installed to the upper half portion in the ice-making chamber 220 and the lower tray 224" installed to the lower half portion in the ice-making chamber 220.

The ice tray 224 is divided into a plurality of spaces and to make ice having a predetermined size by freezing water gathered in each space. Generally, the ice tray is divided into a plurality of quadrangular spaces so as to form quadrangular lumps of ice.

Meanwhile, a water dish 226 and a water supply pipe 226' for guiding water to the lower tray 224" is further provided inside of the ice-making chamber 220. The water dish 226 is formed in a dish-shaped vessel and collects water supplied from the water bucket 210 through the water supply hole 214. The water collected by the water dish 226 is guided to the lower tray 224" along the water supply pipe 226'. Hence, the water supply pipe 226' is formed to vertically extend in the ice-making chamber 220.

More specifically, although not shown in detail, the inside of the water bucket 210 is divided into two spaces in the left and right sides, so that water to be supplied to the upper tray 224' is stored in one space (for example, the left space) and water to be supplied to the lower tray 224" is stored in the other space (for example, the right space). Furthermore, the left and right spaces are provided with the water supply holes 214 and the opening and closing lever 212.

Meanwhile, as shown in FIG. 5, the plurality of ice trays 224 are installed to be spaced apart vertically and are also arranged to be spaced apart from each other by a certain distance in the fore and aft direction. That is, the upper tray 224' is arranged to be biased rearward (leftward in FIG. 5) in the ice-making chamber 220, and the lower tray 224" is arranged to be biased forward (rightward in FIG. 5) in the ice-making chamber 220. Hence, the water supply pipe 226' is vertically arranged through the front (the right side in FIG. 5) of the upper tray 224' and supplies the water in the water bucket 210 to the lower tray 224".

Accordingly, the water in the left space of the water bucket 210 directly drops into the upper tray 224', and the water in the right space drops into the lower tray 224" through the water dish 226 and the water supply pipe 226'. Furthermore, the left and right spaces of the water bucket 210 are formed to have the same size as the inner spaces of the upper tray 224' and the lower tray 224". Hence, if all water in the left and right spaces of the water bucket 210 is supplied to the ice trays 224, the inner spaces of the ice trays 224 are all filled with water.

FIGS. 6 to 11 illustrate the specific constitution of a coupling means that enables the ice-making case 202 to be hooked and fixed to the back side of the freezing chamber door 100 without a separate coupling tool or operation.

Figure 6:
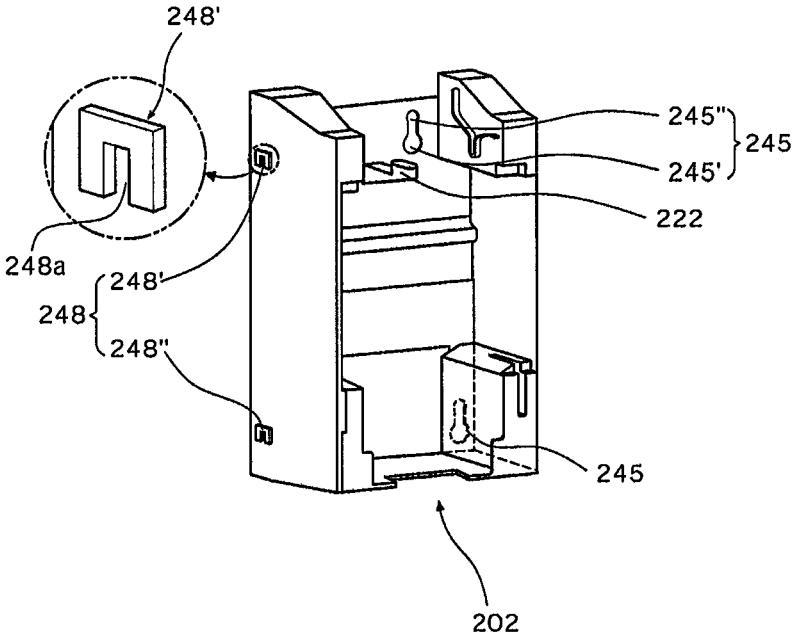
FIG. 6 is a perspective view of an ice-making case of the first embodiment of the present invention.
Figure 7:
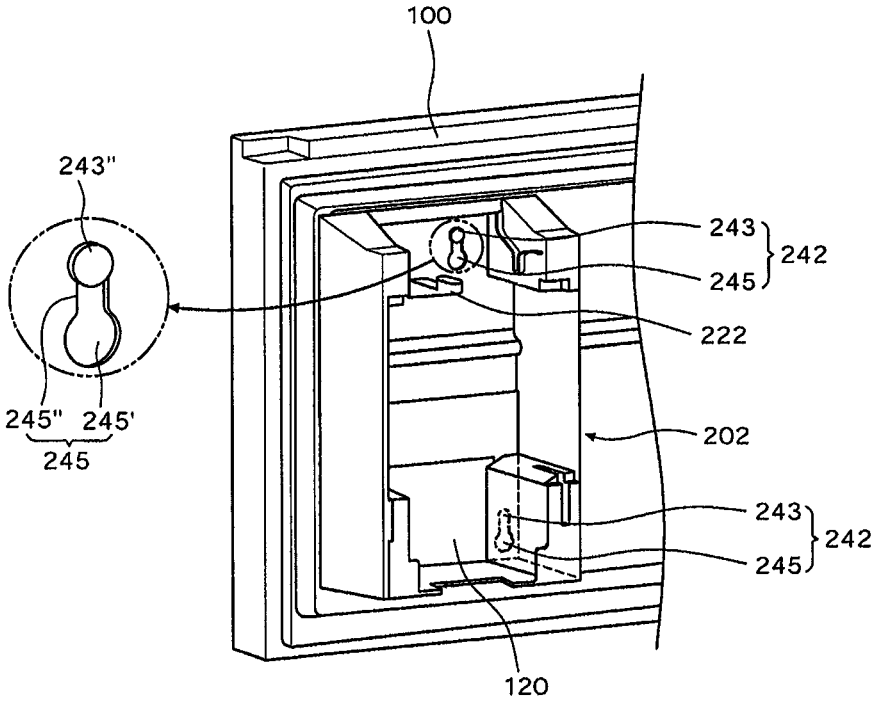
FIG. 7 is a perspective view illustrating a state where the ice-making case of the first embodiment of the present invention is installed to a back side of the freezing chamber door.
Figure 8:
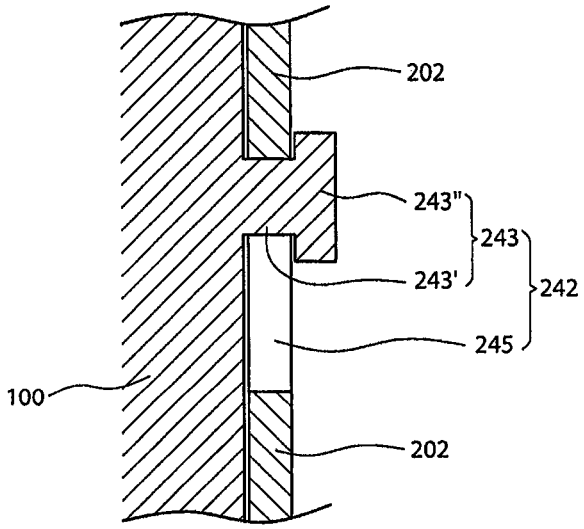
FIG. 8 is a side sectional view illustrating a coupling state of a front mounting unit of the first embodiment of the present invention.
Figure 9:
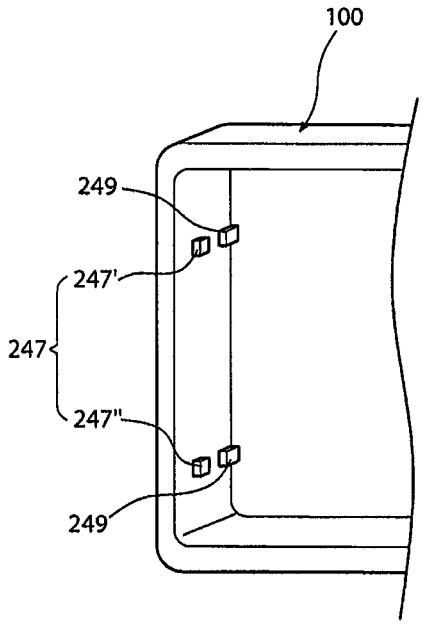
FIG. 9 is a partial perspective view of the back side of the freezing chamber door, showing a coupling protrusion of the first embodiment of the present invention.
Figure 10:
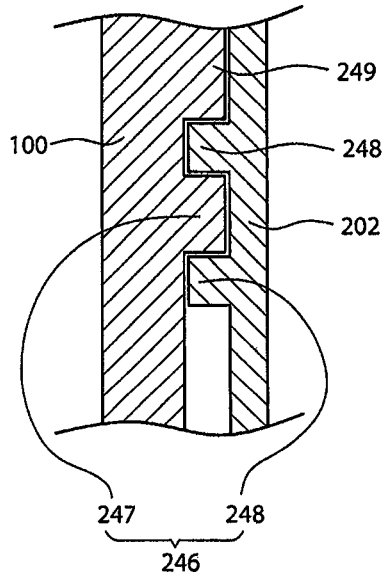
FIGS. 10 and 11 are plan and side sectional views illustrating a coupling state of a side mounting unit of the first embodiment of the present invention.
Figure 11:
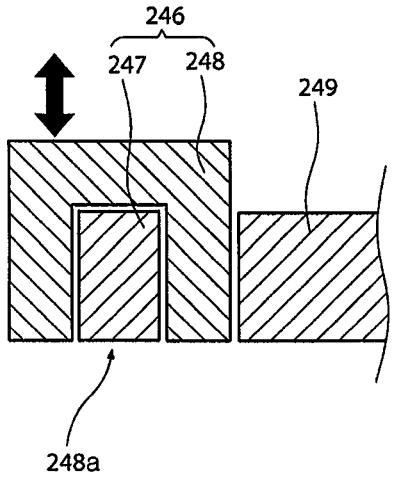

FIGS. 6 and 7 illustrate a perspective view of the ice-making case 202 and a view showing that the ice-making case 202 is installed to the freezing chamber door 100, and FIG. 8 is a side sectional view illustrating a state where the front side of the ice-making case 202 is fixed by means of a front mounting unit. In addition, FIG. 9 is a partial perspective view of the back side of the freezing chamber door 100 showing a coupling protrusion for fixing the lateral side of the ice-making case 202 to the freezing chamber door 100, and FIGS. 10 and 11 are respectively a top sectional view and a side sectional view illustrating a state where the ice-making case 202 is fixed to the edge of the freezing chamber door 100 by means of a side mounting unit.

As shown in the figures, the ice-making case 202 is attached to and detached from the back side of the freezing chamber door 100 by means of a coupling means, wherein the coupling means includes front mounting units 242 that enable the front side (the rear side in FIGS. 6 and 7) of the ice-making case 202 to be caught to the back side (the front side in FIG. 6) of the freezing chamber door 100, and side mounting units 246 that enable the lateral side (the left side in FIGS. 6 and 7) of the ice-making case 202 to be caught and fastened to the inside of the edge of the freezing chamber door 100.

The front mounting unit 242 includes a fastening hook 243 and a fastening recess 245 that are molded on the back side of the freezing chamber door 100 and the rear side of the ice-making case 202 to have shapes corresponding to each other and are coupled to each other. That is, the fastening hook 243 has a structure that enables to be inserted into and locked to the fastening recess 245 not to escape therefrom.

The fastening hook 243 includes a supporting part 243' integrally formed to protrude rearward (rightward in FIG. 8) from the back side of the freezing chamber door 100 and a circular locking plate 243" formed on the end (the right end in FIG. 8) of the supporting part 243'.

The left-to-right width of the supporting part 243' (the diameter in a case where it is formed in a cylindrical shape) is formed to be smaller than the diameter of the locking plate 243". That is, the circular locking plate 243" is formed to have the diameter larger than the left-to-right width of the supporting part 243'. Hence, the supporting part 243' is inserted into and fixed to a locking part 245" of the fastening recess 245, which will be described later.

The fastening recesses 245 are formed on the rear side of the ice-making case 202, and correspond to the fastening hooks 243 in number and position. Hence, as shown in FIG. 7, the fastening recesses 245 are respectively formed on the right sides of the upper and lower ends of the ice-making case 202.

As shown in the figures, the fastening recess 245 is formed such that the shapes of the upper and lower half portions and sizes of the left-to-right widths thereof are respectively different from each other. That is, the fastening recess 245 includes a lower through part 245' that has a relatively large left-to-right width (diameter) and the upper locking part 245" that is formed to have a smaller left-to-right width than that of the through part 245' and is formed by being cut away to communicate with the through part 245'.

The through part 245' is formed in a circular shape and is formed to have a larger diameter than that of the locking plate 243". In addition, the locking part 245" is formed to have a smaller left-to-right width than the diameter of the locking plate 243". Hence, if the locking plate 243" of the fastening hook 243 passes through the through part 245' and is fitted thereinto, and then, is positioned in the locking part 245", thereby being prevented from escaping forward (FIG. 7).

The side mounting unit 246 includes a coupling protrusion 247 and a coupling hook 248 that are respectively molded on the edge of the freezing chamber door 100 and the lateral side of the ice-making case 202 to have shapes corresponding to each other and to be fitted to each other.

The coupling protrusion 247 is formed such that it is integrally formed to protrude inwardly from the lateral side (the left side in FIG. 9) of the edge of the freezing chamber door 100. The coupling protrusions 247, which are to fix the upper and lower portions of the left end of the ice-making case 202, include the upper coupling protrusion 247' and the lower coupling protrusion 247" that are formed to be spaced apart from each other by a predetermined distance.

Guide protrusions 249 are further formed on the rear (FIG. 9) of the coupling protrusions 247. The guide protrusions 249 protrude from positions spaced apart rearward from the coupling protrusions 247 by a predetermined distance and are parts for guiding the installation of the ice-making case 202.

The coupling hooks 248 are parts that are formed to protrude outwardly from the left outside of the ice-making case 202 and to be caught to the coupling protrusions 247 and have '∩' shape. That is, there are formed receiving recesses **248*a* in which the coupling protrusions 247 are received, respectively, and the receiving recesses 248*a* are formed to be downwardly opened such that the coupling protrusions 247** can be moved in and out.

The coupling hooks 248 are provided at positions corresponding to the coupling protrusions 247, and correspond in number to the coupling protrusions 247. Hence, the coupling hooks 248 are respectively formed on the upper and lower ends of the left side of the ice-making case 202 and includes the upper hook 248' formed on the upper portion and caught to the upper coupling protrusion 247' and the lower hook 248" formed on the lower portion and caught to the lower coupling protrusion 247".

The fastening hooks 243 and the coupling protrusions 247 are formed integrally with the edge of the freezing chamber door 100 while the fastening recesses 245 and the coupling hooks 248 are formed on the ice-making case 202 as described in the aforementioned embodiment, and vice versa. That is, the fastening hooks 243 and the coupling protrusions 247 may be formed integrally with the ice-making case 202 and the fastening recesses 245 and the coupling hooks 248 may be formed on the freezing chamber door 100.

Hereinafter, a process of installing the ice-making case 202 on the back side of the freezing chamber door 100 will be described.

The ice-making case 202 is gripped by hand and then brought into contact with the back side of the freezing chamber door 100. At this time, the ice-making case 202 is brought into close contact with the upper end of the back side of the freezing chamber door 100. Accordingly, the coupling hooks 248 are positioned above the receiving recesses **248*a*, and the fastening hooks 243 are positioned in front of the through parts 245' of the fastening recesses 245**.

As such, if the ice-making case 202 is brought into close contact with the back side of the freezing chamber door 100, the receiving recesses **248*a* of the coupling hooks 248 formed on the left end are positioned above the coupling protrusions 247. Then, the locking plates 243" of the fastening hooks 243 pass through the through parts 245' of the fastening recesses 245** to protrude forwardly.

Next, the ice-making case 202 is lowered. Accordingly, the left coupling hooks 248 are lowered, so that the coupling protrusions 247 are inserted into and received in the receiving recesses **248*a* of the coupling hooks 248. In addition, the supporting parts 243' of the fastening hooks 243 are moved from the through parts 245' of the fastening recesses 245 to the locking parts 245"**.

As such, the installation of the ice-making case 202 is completed. That is, the left end of the ice-making case 202 is prevented from moving in the fore-and-aft direction because the coupling protrusions 247 are inserted into the receiving recesses **248*a*, and the locking plate 243" of the fastening hook 243 is prevented from moving in the front direction and the left and right direction by the locking parts 245" of the fastening recesses 245. Hence, as shown in FIG. 7, the ice-making case 202 is fixed to the back side of the freezing chamber door 100**.

After the ice-making case 202 is installed as described above, the water bucket 210, the ice-making chamber 220 and the ice bank 230 are installed. That is, the water bucket 210 is installed to the upper end of the ice-making case 202, the ice-making chamber 220 is installed to the central portion thereof, and the ice bank 230 is installed to the lower end thereof.

In addition, the ice-making case 202 so installed is detached in reverse order to the installation order thereof. That is, the ice-making case 202 is lifted up in a state shown in FIG. 7. As such, the coupling protrusions 247 downwardly escape from the receiving recesses 248*a* of the coupling hooks 248, and the locking plates 243" of the fastening hooks 243 are lowered from the locking parts 245" of the fastening recesses 245 and are positioned in the through parts 245'.

In this state, the ice-making case 202 is pulled forward (in FIG. 7). Then, the locking plates 243" of the fastening hooks 243 pass through the through parts 245' of the fastening recesses 245, and the coupling hooks 248 pass above the coupling protrusions 247 and move in the front direction. Thus, the ice-making case 202 is separated from the back side of the freezing chamber door 100.

Figure 13:
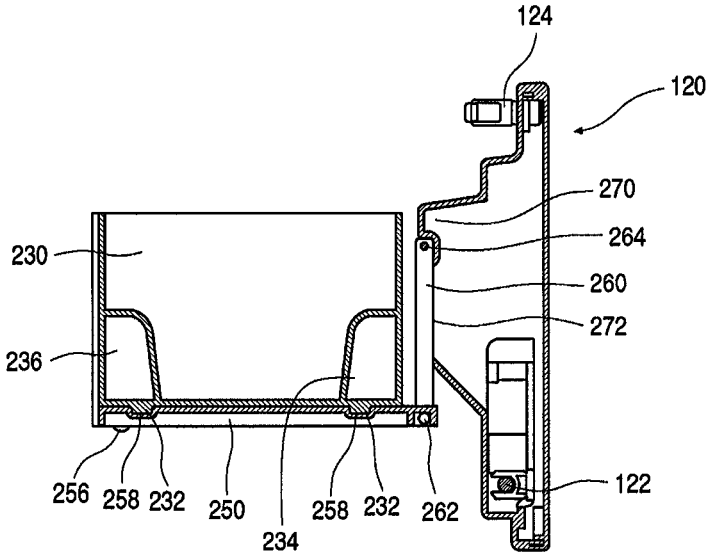
FIG. 13 is a side sectional view illustrating an installation state of the home-bar door and the ice bank of the first embodiment of the present invention.

FIGS. 12 and 13 illustrate a connecting relationship of the home-bar door 120 and the ice bank 230 in more detail. That is, FIG. 12 is an exploded perspective view illustrating the home-bar door 120 and the ice bank 230 in detail, and FIG. 13 is a side sectional view of the home-bar door 120 and the ice bank 230.

As shown in the figures, the ice bank 230 is formed in the shape of a quadrangular box with an upper part opened, and the left and right sides (the front and rear in FIG. 12) of the lower ends thereof are depressed and formed to prevent its interference with a movement guide 280, which will be described below.

Furthermore, a plurality of locking protrusions 232 which protrude downwardly are provided on the bottom surface of the ice bank 230. The locking protrusions 232 are received in locking recesses 258 of a bank supporting plate 250, which will be described later, and forcibly cause the ice bank 230 to move forward and rearward while it is placed on the bank supporting plate 250.

Meanwhile, bank pulls 234 and 236 are respectively formed on the front and rear (the left and right sides in FIGS. 12 and 13) of the lower ends of the ice bank 230. That is, the front pull 234 is formed on the front end (the right end in FIGS. 12 and 13) of the ice bank 230, and the rear pull 236 is formed on the rear end (the left end in FIGS. 12 and 13) of the ice bank 230. The front and rear pulls 234 and 236 are parts that enable the user to catch for drawing out the ice bank 230 forward and rearward (leftward and rightward in FIGS. 12 and 13).

The bank supporting plate 250 that can slide forward and rearward is provided below the ice bank 230. That is, the bank supporting plate 250 is to support the ice bank 230 and is installed to the floor surface of the ice-making case 202.

The bank supporting plate 250 is preferably formed of a flat plate having a predetermined thickness, the center of the front end (the right end in FIG. 12) thereof is depressed rearward (leftward in FIG. 12) to define a link receiving part 252 in which one end of a connection link 260, which will be described later, is received. In addition, a supporting plate recesses 254 into which supporting plate protrusions 262 to be described below are inserted are respectively formed on the left and the right sides (the front and the rear in FIGS. 12 and 13) of the link receiving part 252.

The rear end (the left end in FIG. 12) of the bank supporting plate 250 is provided with moving rollers 256. The moving rollers 256, which are to enable the bank supporting plate 250 to smoothly move forward and rearward within the ice-making case 202, are rotatably installed to the left and right side ends (the front and rear ends in FIGS. 12 and 13) of the rear end of the bank supporting plate 250, respectively.

The plurality of locking recesses 258 downwardly depressed are formed on the top side of the bank supporting plate 250. The locking recesses 258 are parts that receive the locking protrusions 232 of the bottom surface of the ice bank 230 and are coupled thereto. Thus, it is preferred that the locking recesses 258 and the locking protrusions 232 are formed to correspond in number, position and shape to each other.

The connection link 260 is further provided in the rear (the left side in FIGS. 12 and 13) of the home-bar door 120. The connection link 260 is to enable the home-bar door 120 and the bank supporting plate 250 to cooperate with each other and is formed in the shape of a flat plate having a predetermined thickness as illustrated.

The supporting plate protrusions 262 rotatably inserted into the supporting plate recesses 254 are respectively formed to protrude outwardly on both sides of the lower end of the connection link 260. Thus, the lower end of the connection link 260 and the front end (the right end in FIGS. 12 and 13) of the bank supporting plate 250 are hinged to each other.

Door protrusions 264 are formed to protrude outwardly on both sides of the upper end of the connection link 260. The door protrusions 264 are parts rotatably inserted into door recesses 274, which will be described later, formed on the home-bar door 120.

Hinge protrusions 122' that are the center of rotation of the home-bar door 120 are formed to protrude outwardly on both sides of the lower end of the home-bar door 120. In addition, a guide part 270 protruding rearward (leftward in FIGS. 12 and 13) is formed on the rear side (the left side in FIGS. 12 and 13) of the home-bar door 120, and the guide part 270 is inwardly (rightward in FIGS. 12 and 13) depressed to define a receiving part 272 that is a predetermined space. The receiving part 272 is a part in which the upper half portion of the connection link 260 is received.

The door recesses 274 are respectively formed on the left and right upper ends of the receiving part 272. The door recesses 274 are parts into which the aforementioned door protrusions 264 of the connection link 260 are rotatably inserted. Hence, when the door protrusions 264 of the connection link 260 are inserted into the door recesses 274 of the home-bar door 120, the upper end of the connection link 260 is connected to the upper half portion of the home-bar door 120, so that the bank supporting plate 250 cooperates with the home-bar door 120 to move forward and rearward (leftward and rightward in FIGS. 12 and 13) as the home-bar door 120 is opened and closed.

Figure 14:
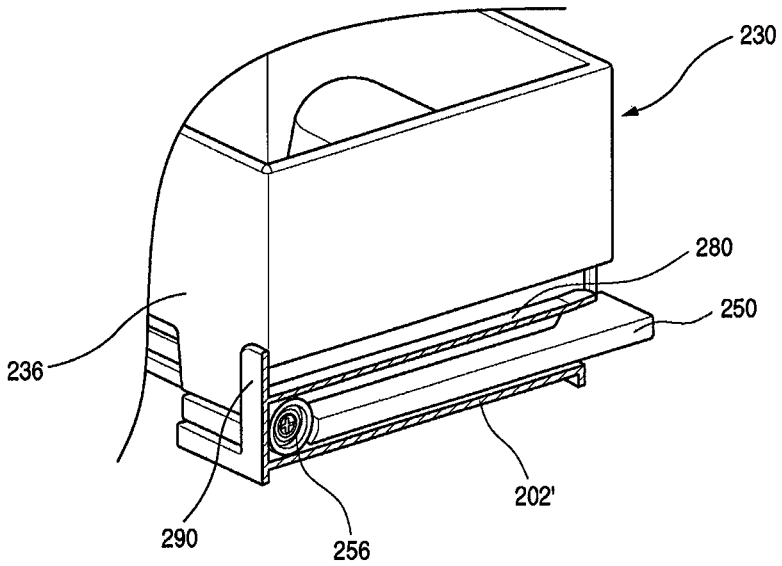
FIG. 14 is a partial side perspective view illustrating an installation state of a bank supporting plate and a movement guide of the first embodiment of the present invention.
Figure 15:
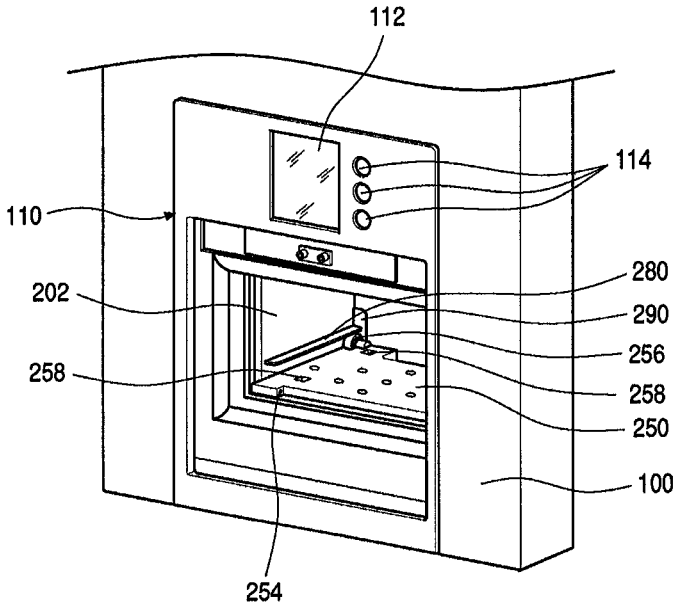
FIG. 15 is a partial front perspective view illustrating an installation state of the bank supporting plate and the movement guide of the first embodiment of the present invention.

Meanwhile, the movement guides 280 as shown in FIGS. 14 and 15 are formed in the fore and aft direction on the lateral sides of the lower end of the ice-making case 202. That is, the movement guides 280 are formed to protrude inwardly and extend in the fore and aft direction at positions upwardly spaced apart by a predetermined distance from a floor surface 202' of the ice-making case 202. Hence, the moving roller 256 is positioned between the floor surface 202' of the ice-making case 202 and the movement guide 280 to be guided forward and rearward.

Furthermore, catching pieces 290 are formed to protrude upwardly on the rear side of the lower end of the ice-making case 202. The catching pieces 290 serve to make the ice bank 230 be readily positioned in place when the ice bank 230 is installed or positioned in its original location by being pushed in the rear direction after being forwardly drawn out.

More specifically, as shown in the figure, the catching pieces 290 having a predetermined size are formed to extend upwardly beyond the installation height of the movement guides 280 on the rear left and right sides of the lower end of the ice-making case 202, and interfere with both side ends of the ice bank 230. Thus, the ice bank 230 is prevented from moving in the rear direction by the catching pieces 290.

Of course, the catching pieces 290 do not completely prevent the rearward movement of the ice bank 230. That is, because the rear of the ice-making case 202 is open as illustrated, the ice bank 230 (see FIG. 17) can be drawn out rearward.

However, since the left and right sides of the rear end (the front end in FIG. 14) of the ice bank 230 partially interfere with the catching pieces 290, it is possible to prevent the accident that the ice bank 230 slides on the upper surface of the bank supporting plate 250 and is naturally drawn out rearward (forward in FIG. 14) to drop contrary to user's intention.

It is exemplarily described in the aforementioned embodiment that the connection link 260 is formed in the shape of a flat plate. However, the connection link may be formed in a structure having various shapes instead of a flat plate.

In addition, it is reasonable that a connection state and structure between the connection link 260, the home-bar door 120 and the bank supporting plate 250 can be changed into various configurations. That is, as long as it is possible to achieve the object that the ice bank 230 cooperates with the home-bar door 120 to be drawn in and out as the home-bar door 120 rotates (is opened), the connection state and structure between the connection link 260, the home-bar door 120 and the bank supporting plate 250 can be changed into various configurations Hereinafter, a process of drawing out ice stored in the ice bank 230 to the outside will be described in more detail with reference to FIGS. 12 to 16.

First, a user pushes the upper end of the home-bar door 120 rearward. Then, the coupling hook 124 fixed to the hook fixture 126 is separated therefrom, so that the home-bar door 120 is opened, which is a state shown in FIG. 16.

More specifically, as the home-bar door 120 rotates forward (clockwise in FIG. 5) about the door hinge 122 of the lower end thereof, the connection link 260 also rotates clockwise from an upright state as shown in FIG. 13.

As such, as the connection link 260 rotates clockwise (in FIG. 13), the bank supporting plate 250 connected to the connection link 260 also moves forward (rightward in FIG. 13). That is, because the top-to-bottom height of the connection link 260 is relatively smaller than that of the home-bar door 120, if the home-bar door 120 is completely opened horizontally as shown in FIG. 16, a certain part of the bank supporting plate 250 moves forward (rightward in FIG. 13).

As such, if the bank supporting plate 250 moves forward (rightward in FIG. 13), the ice bank 230 placed on the upper surface of the bank supporting plate 250 also moves forward (rightward in FIG. 13). Hence, a portion of the front end of the ice bank 230 is exposed to the outside of the front of the freezing chamber door 100 (see FIG. 16).

At this time, because the locking protrusions 232 formed on the bottom surface of the ice bank 230 are received in the locking recesses 258 formed on the bank supporting plate 250, as the bank supporting plate 250 is drawn out forward, the ice bank 230 is simultaneously drawn out forward without slide. At this time, the moving rollers 256 formed on the rear end of the bank supporting plate 250 make it possible for the bank supporting plate 250 and the ice bank 230 to move forward.

Figure 16:
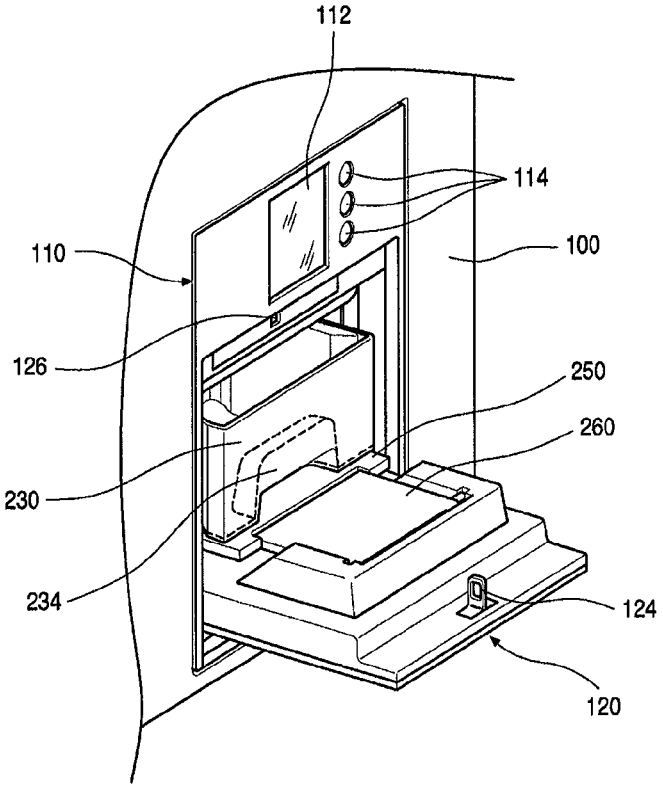
FIG. 16 is a use state view illustrating an opened state of the home-bar door of the first embodiment of the present invention.

Through the aforementioned process, a portion of the ice bank 230 is exposed to the outside as shown in FIG. 16, and then, the user directly takes out ice in the ice bank 230. When the user intends to take out a larger amount of ice, the ice bank 230 is further drawn out forward.

More specifically, when the user catches the front pull 234 of the ice bank 230 and exerts force thereon forward in the state as shown in FIG. 16, the ice bank 230 is drawn out forward while sliding on the upper surface of the bank supporting plate 250.

At this time, it is more preferred that the user lifts up the front end of the ice bank 230 by a certain distance and draws out the ice bank forward in a state where the user holds the front pull 234. That is, since the locking protrusions 232 of the ice bank 230 are inserted in the locking recesses 258 of the bank supporting plate 250 as shown in FIG. 13, if force is exerted thereon forward with the front end of the ice bank 230 slightly lifted up, the locking protrusions 232 are separated from the locking recesses 258. Thus, the ice bank 230 can be drawn out with a small force.

The ice bank 230 is positioned again in its original location after the ice in the ice bank 230 is taken out, wherein such a process is preformed in reverse order to the aforementioned ice taking-out process.

That is, the ice bank 230 is pushed rearward, so that the locking protrusions 232 of the lower end of the ice bank 230 are received in the locking recesses 258 of the bank supporting plate 250, which is a state as shown in FIG. 16.

At this time, the catching pieces 290 prevent the ice bank 230 from being pushed excessively rearward. That is, when the rear end of the ice bank 230 interferes with the catching pieces 290, the rearward movement of the ice bank 230 is interrupted.

As such, the catching pieces 290 serve to guide the ice bank 230 to its place in a case where the ice bank 230 is drawn out forward and is then positioned in its original location. Hence, it is possible to prevent the accident that the ice bank 230 is excessively pushed rearward to drop or to strike other objects (or stored goods) in the rear thereof.

At this time, the home-bar door 120 is closed by lifting up the front end of the home-bar door 120. That is, the upper end of the home-bar door 120 is pushed in rearward, so that the coupling hook 124 is inserted into the hook fixture 126. As such, because the hook fixture 126 allows the coupling hook 124 to be fixed, the home-bar door 120 maintains its closed state as shown in FIGS. 3 and 13.

Of course, at this time, the home-bar door 120 together with the connection link 260 stand upright, and the bank supporting plate 250 is simultaneously pushed in rearward (leftward in FIG. 13), which is a state as shown in FIG. 13.

Figure 17:
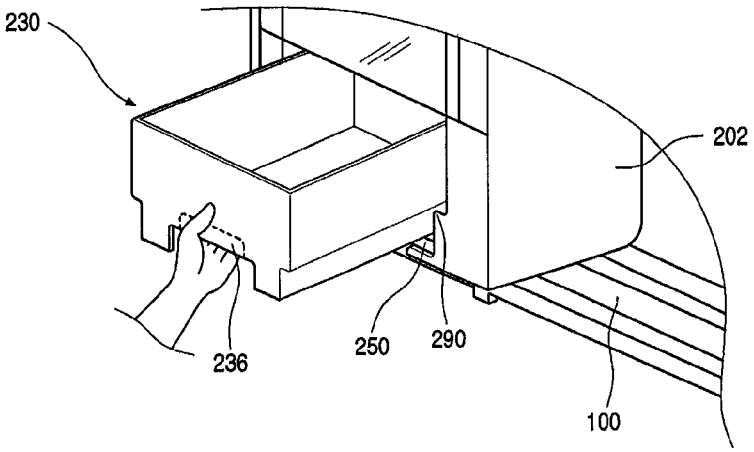
FIG. 17 is a use state view illustrating a state where the ice bank of the first embodiment of the present invention is drawn out rearward.

Meanwhile, according to the present invention, the ice bank 230 can also be drawn out rearward as shown in FIG. 17. That is, the ice bank 230 is drawn out rearward in a case where the ice bank 230 is excessively loaded with ice and thus it is difficult to draw out the ice bank 230 forward even when the home-bar door 120 is opened or the after-sales service for the inside of the ice-making assembly 200 is performed.

More specifically, as shown in FIG. 17, the ice bank 230 is drawn out rearward (forward in FIG. 17) after the freezing chamber door 100 is opened.

At this time, while being caught by hand, the rear pull 236 of the ice bank 230 is slightly lifted up and is then drawn out. Then, the ice bank 230 is separated from the catching piece 290 and is drawn out rearward (forward in FIG. 17).

That is, as shown in the figure, since the upper end of the catching piece 290 and the rear end (the front end in FIG. 17) of the ice bank 230 are in contact with each other, it is difficult to move the ice bank 230 if the ice bank 230 is drawn out rearward (forward in FIG. 17) as it is. Hence, the rear end (the front end in FIG. 17) of the ice bank 230 is firstly lifted up by a certain distance, so that both the side ends of the ice bank 230 are separated from the catching piece 290. Then the ice bank 230 is drawn out by being pulled rearward (forward in FIG. 17).

Next, in order to position the ice bank 230 in its original location, the ice bank 230 is pushed into the ice-making case 202 in a state as shown in FIG. 17. Then, the ice bank 230 is pushed in while the lateral side ends of the ice bank 230 are brought into contact with the upper ends of the catching pieces 290, so that the ice bank is positioned in its original location.

Figure 18:
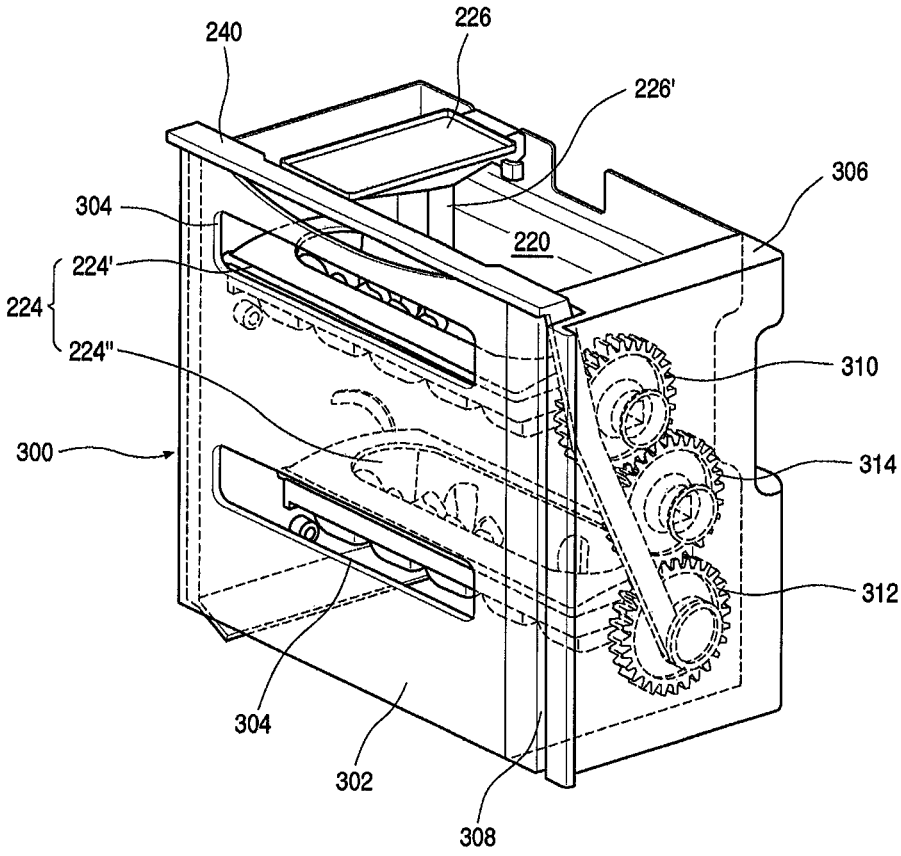
FIG. 18 is a detailed rear perspective view illustrating an ice-making chamber of the first embodiment of the present invention.
Figure 19:
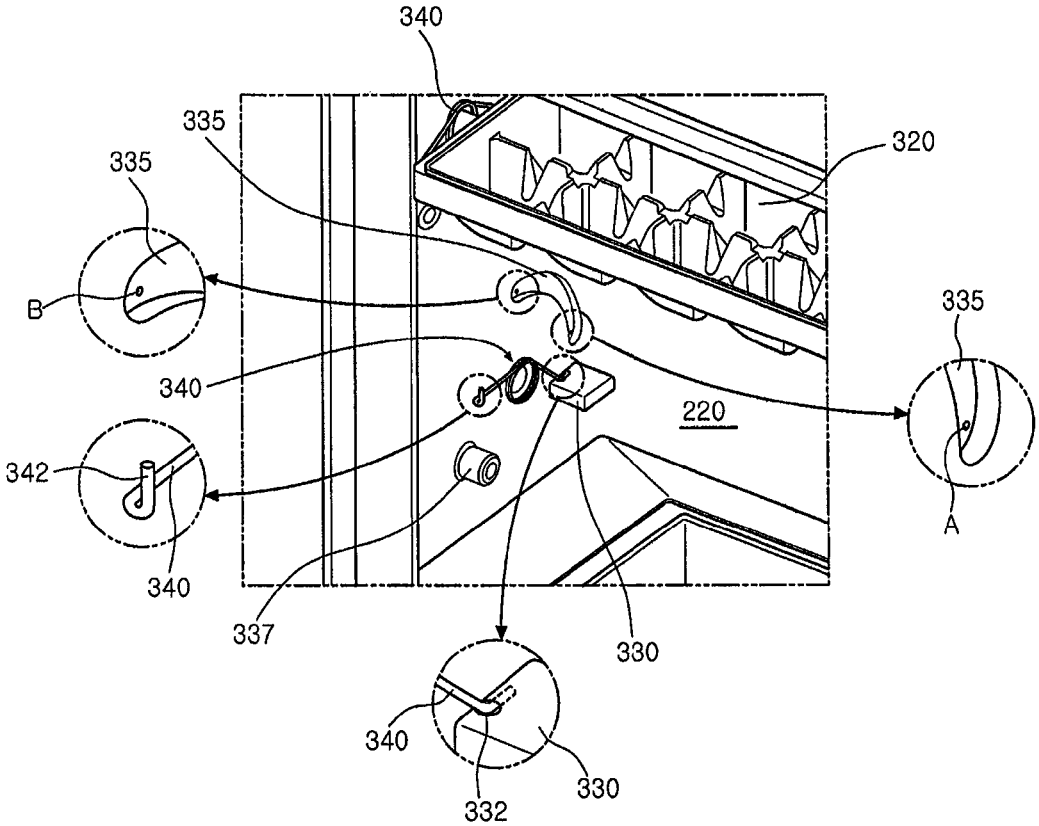
FIG. 19 is a partial perspective view illustrating an inside of the ice-making chamber of the first embodiment of the present invention.
Figure 20:
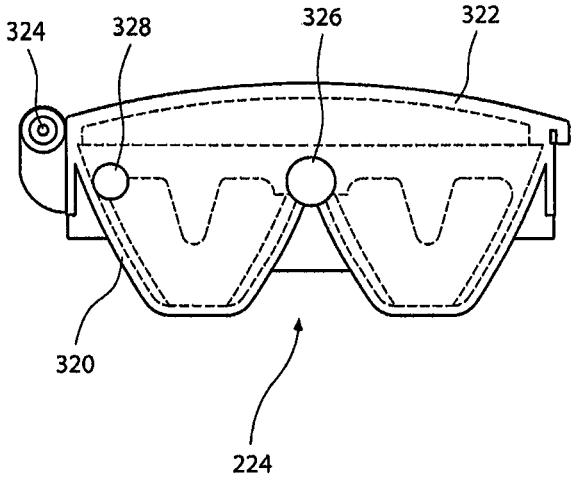
FIG. 20 is a side view illustrating an ice tray of the first embodiment of the present invention.
Figure 21:
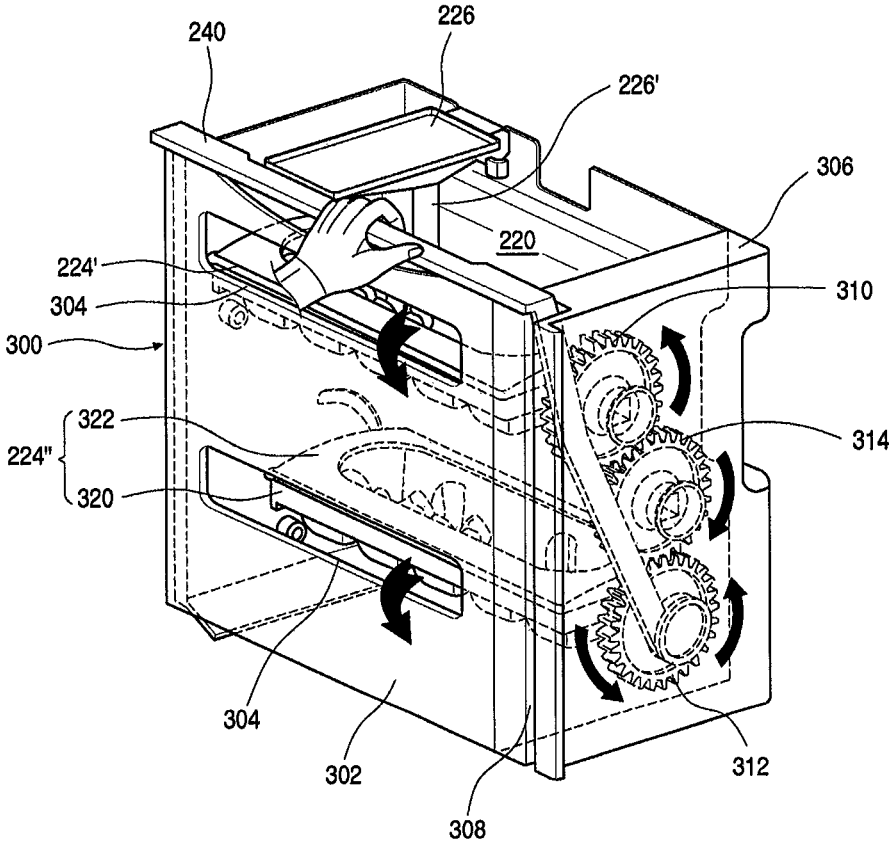
FIG. 21 is a use state view illustrating rotation directions of respective gears when operating an ice-separating lever of the first embodiment of the present invention.

FIGS. 18 to 20 illustrate the inside of the ice-making chamber 220 in more detail. That is, FIG. 18 is a perspective view of the ice-making chamber 220, FIG. 19 partially illustrates the inside of the ice-making chamber 220, and FIG. 20 is a side view of the ice tray 224.

As shown in the figures, the ice-making chamber 220 is surrounded by a tray case 300 having a shape of a quadrangular box with upper and lower parts opened. The rear side 302 of the tray case 300 is made of a transparent material to allow the inside thereof to be viewed. Hence, the user can perform the ice-separating operation while viewing the inside of the ice-making chamber 220 from the outside.

Furthermore, cold air through holes 304 for defining a flow passages of cold air are respectively formed on the upper and lower portions of the rear side 302 of the tray case 300. More preferably, the cold air through holes 304 are respectively formed in the rear (in front in FIG. 18) of the upper tray 224' and the lower tray 224".

The right side of the tray case 300 is provided with a gear case 306 defining a predetermined space. Lever guide grooves 308 communicating with each other are formed on the front ends of the front side (FIG. 18) and the top and bottom of the gear case 306. The lever guide grooves 308 are portions into which the ice-separating lever 240 is inserted and which allow it to move.

A plurality of tray gears 310 and 312 are installed in the gear case 306. The tray gears 310 and 312 are gears each of which has gear teeth formed on its circumference surface.

The tray gears 310 and 312 are installed to be coaxial with the ice trays 224, thereby transmitting rotational force to the ice trays 224. That is, the ice trays 224 are connected and installed to rotating shafts of the tray gears 310 and 312 and rotate together therewith.

More specifically, the tray gears 310 and 312 include the upper gear 310 connected and installed to the right side of the upper tray 224' and the lower gear 312 connected and installed to the right side of the lower tray 224". Furthermore, the upper tray 224' is connected and installed to the rotating shaft of the upper gear 310, and the lower tray 224" is integrally connected and installed to the rotating shaft of the lower gear 312. Hence, the upper gear 310 and the upper tray 224', as well as the lower gear 312 and the lower tray 224", rotate together.

A connection gear 314 is further provided between the upper gear 310 and the lower gear 312. That is, the connection gear 314 is installed between the upper gear 310 and the lower gear 312 and serves to transmit the rotational force of the lower gear 312 to the upper gear 310.

The connection gear 314 is a gear having gear teeth formed on its circumference surface like the upper gear 310 and the lower gear 312. That is, the upper and lower gears 310 and 312 and the connection gear 314 have the gear teeth corresponding to each other formed on the respective circumference surfaces, thereby being meshed to each other. Hence, when the lower gear 312 rotates, the upper gear 310 also rotates in the same direction as the lower gear.

The ice-separating lever 240 is a driving device for performing ice-separating operation as described above, and an end thereof is connected and installed to the rotating shaft of at least one tray of the plurality of ice trays 224.

The ice-separating lever 240 is formed in the shape of 'ㄷ' as illustrated and is installed to surround the tray case 300. Furthermore, ends of the ice-separating lever 240 are connected and installed to a rotating shaft of the lower tray 224".

More specifically, the right end of the ice-separating lever 240 is fixedly connected to the right of the rotating shaft of the lower gear 312, and the left end thereof is integrally connected and installed to the left of the rotating shaft of the lower gear 312. Then, the ends of the ice-separating lever 240 are integrally connected and installed to the same rotating shaft as the lower gear 312 and the lower tray 224". Hence, as the ice-separating lever 240 rotates, the lower gear 312 and the lower tray 224" simultaneously rotate.

The ice tray 224 includes a tray body 320 in which water is contained and frozen, and a tray cover 322 that is coupled to the top side of the tray body 320. As illustrated, a plurality of freezing spaces are formed in the tray body 320, and the tray cover 322 serves to prevent the tray body 320 from overflowing.

The central portion of the tray cover 322 is penetrated vertically to and enables cold air and water to drop, and the rear end (the left end in FIG. 20) of the tray cover 322 is hinged to the rear end (the left end in FIG. 20) of the tray body 320. That is, the rear end (the left end in FIG. 20) of the tray cover 322 is provided with a cover hinge 324 that enables the tray cover 322 to be rotatably coupled to the tray body 320.

Meanwhile, tray rotating shafts 326 are formed to protrude laterally from the left and right central portions (the front and rear central portions in FIG. 20) of the ice tray 224. The tray rotating shafts 326 are the rotational center axis of the ice tray 224, wherein the tray rotating shaft 326 formed on the right side (the rear side in FIG. 20) is fixedly connected to the lower gear 312 and the tray rotating shaft 326 of the left side (the front side in FIG. 20) is rotatably installed to the left of the tray case 300.

A rotation guide protrusion 328 is formed to protrude leftward (forward in FIG. 20) on the rear of the left end (the front end in FIG. 20) of the ice tray 224. The rotation guide protrusion 328 moves along a rotation guide groove 335, which will be described later, to guide the rotation of the ice tray 224 and simultaneously control the degree of rotation.

Meanwhile, as shown in FIG. 19 and FIG. 20, a supporting protrusion 330 is formed to inwardly (rightward) protrude on the left inner wall of the tray case 300. The supporting protrusion 330 is formed in the shape of a flat plate having a predetermined thickness, and serves to support the rear lower end of the ice tray 224. That is, in a case where the ice tray 224 is maintained horizontal, its lower end is placed on the top side of the supporting protrusion 330.

A spring fixing recess 332 is formed on the top side of the supporting protrusion 330. The spring fixing recess 332 is a part into which the rear end of a return member 340, which will be described later, is fixedly inserted.

A rotation guide groove 335 having a circular arc shape is formed above the supporting protrusion 330. The rotation guide groove 335 is a part into which the rotation guide protrusion 328 of the ice tray 224 is movably inserted. Hence, the rotation guide protrusion 328 is positioned at a lower region 'A' when the ice tray 224 is maintained horizontal, while the rotation guide protrusion is positioned at an upper region 'B' when the ice tray 224 rotates for ice-separating operation.

A cover stopping protrusion 337 protruding inwardly is further formed in front of the supporting protrusion 330. The cover stopping protrusion 337 is a part that selectively interferes with the front end (the right end in FIG. 20) of the tray cover 322 of the ice tray 224. That is, in a case where the ice tray 224 rotates for ice-separating operation, the front end of the tray cover 322 interferes with the cover stopping protrusion 337, so that the tray cover 322 does not rotate along the tray body 320 any more. Hence, the ice in the tray body 320 can readily drop downwardly.

The return member 340 is further provided in the left end of the ice tray 224. The return member 340, which forcibly causes the ice tray 224 to return to its original state after the ice tray rotates by the ice-separating lever 240, preferably includes a torsion spring as illustrated.

The return member 340 is installed such that its central portion surrounds the tray rotating shaft 326 of the ice tray 224, and the rear end of the return member is inserted into and fixed to the spring fixing recess 332 of the supporting protrusion 330. Furthermore, the front end of the return member 340 is bent upwardly to define a hooking part 342. The hooking part 342 is a portion that is caught to the left-sided front end of the ice tray 224.

Hence, the ice tray 224 tends to always rotate counterclockwise by the rotational force applied from the return member 340, but the supporting protrusion 330 causes such an ice tray 224 to stop.

Although it is exemplarily described in the aforementioned embodiment that a torsion spring is used as the return member 340, various return members instead of the torsion spring may be employed. That is, various other means for providing rotational force to position the ice tray 224 in its original location can be applied.

Furthermore, although in the aforementioned embodiment, the ends of the ice-separating lever 240 are installed to be connected to the same shaft as the lower tray 224" and the lower gear 312, the ice-separating lever 240 may be installed so that the ends thereof are positioned on the same shaft as the upper tray 224' and the upper gear 310.

Hereinafter, a process of separating ice in the ice tray 224 by rotating it will be described in more detail with reference to FIG. 20.

As described above, if the central portion of the ice-separating lever 240 is gripped by hand and then downwardly pulled, the lower gear 312 fixed to the ice-separating lever 240 is rotated counterclockwise. When the lower gear 312 rotates counterclockwise, the connection gear 314 rotates clockwise, whereby the upper gear 310 rotates counterclockwise.

As such, if the lower gear 312 and the upper gear 310 rotate counterclockwise, the lower tray 224" and the upper tray 224' connected thereto also rotate counterclockwise. At this time, the front end of the tray cover 322 strikes the cover stopping protrusion 337 during the rotation of the tray cover 322 in a state of closing the tray body 320, so that the tray cover 322 stops rotating. Hence, the tray cover 322 is gradually opened.

Meanwhile, as the ice tray 224 rotates, the rotation guide protrusion 328 moves along the rotation guide groove 335. Furthermore, when the rotation guide protrusion 328 reaches the upper end ('B' in FIG. 10) of the rotation guide groove 335, the left end of the ice tray 224 stops rotating. Hence, from this time, the ice tray 224 is twisted and the ice in the ice tray is separated. Through this process, the ice in the ice tray 224 is separated and drops into the ice bank 230.

Next, if all the ice in the ice tray 224 drops into the ice bank 230, the user releases the ice-separating lever 240. Then, the lower tray 224" and the upper tray 224' rotate clockwise by the restoring force of the return member 340 and return to their original states (horizontal state). At this time, the ice-separating lever 240 is lifted up along the lever guide groove 308 and is positioned in its original location.

Of course, the operation of pulling the ice-separating lever 240 downwardly can be performed in several times. That is, because the rear side 302 of the tray case 300 is formed of a transparent material, the user can continuously perform the ice-separating operation while directly checking with the eye whether all the ice in the ice tray 224 is separated and drops.

If the ice drops into the ice bank 230 through such a process, the user closes the freezing chamber door 100 and can take out the ice in the ice bank 230 to the outside after opening the home-bar door 120 whenever necessary.

Figure 22:
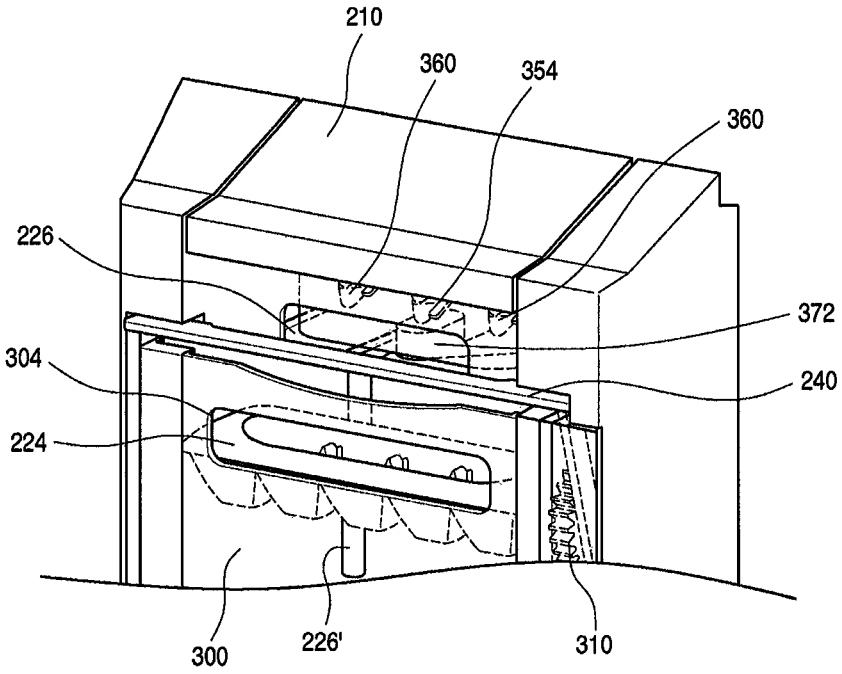
FIG. 22 is a partial rear perspective view illustrating an installation state of a water bucket of the first embodiment of the present invention.
Figure 23:
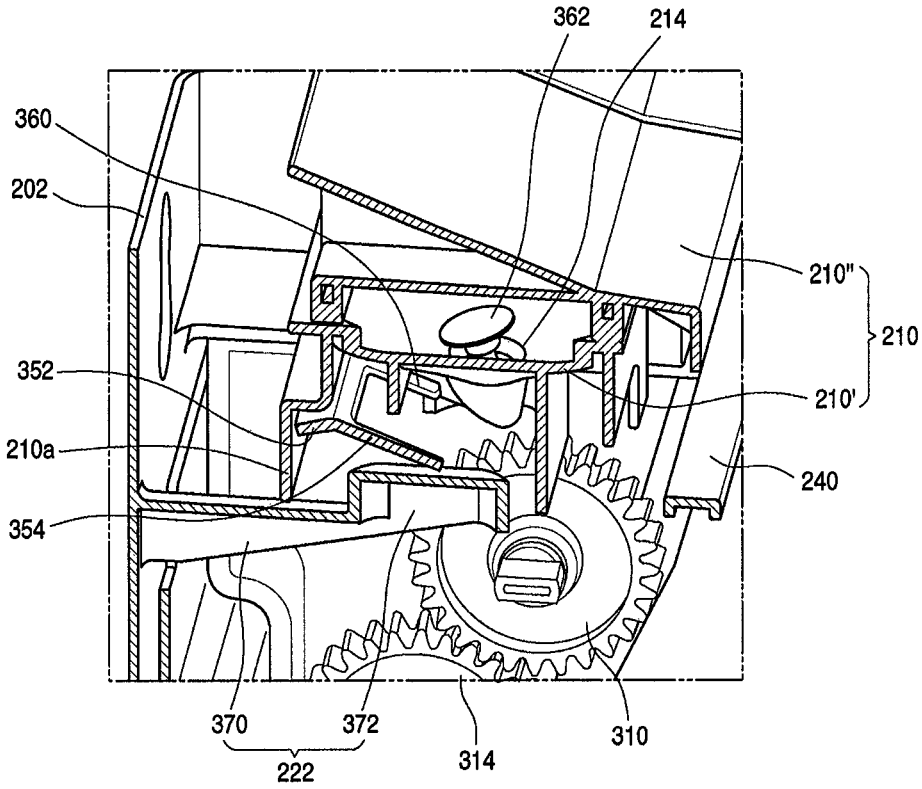
FIG. 23 is a partial cut-away perspective view illustrating an inside of the water bucket of the first embodiment of the present invention.
Figure 24:
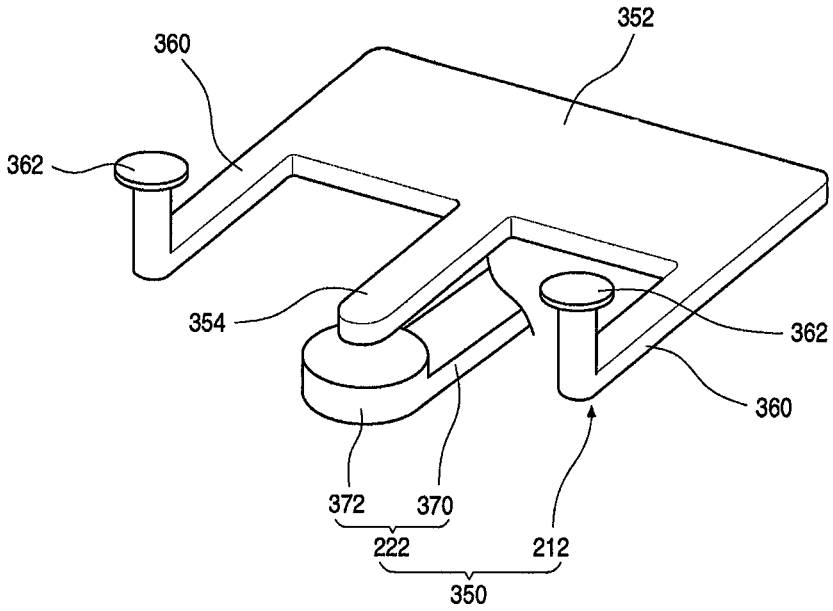
FIG. 24 is a partial perspective view illustrating an opening and closing means of the first embodiment of the present invention.

FIGS. 22 to 24 specifically illustrate the inside of the water bucket 210 and an installation state thereof.

As shown in the figures, the water bucket 210 includes a water bucket body 210' in which a water storage space is defined, and a water bucket cover 210" closing an upper portion of the water bucket body 210'. The water bucket body 210' is divided into two parts, i.e., left and right parts. Hence, water stored in the two parts of the water bucket 210 is respectively supplied to the upper tray 224' and the lower tray 224".

The water storage space of the water bucket 210 is defined to have a size corresponding to that of the inner storage space of the ice trays 224. Hence, all the water stored in the left and right parts of the water bucket 210 is supplied to the upper tray 224' and the lower tray 224", so that even when the upper tray 224' and the lower tray 224" are filled with water, the ice tray 224 does not overflow to the outside.

Meanwhile, the water bucket cover 210" is formed to cover the upper portion of the water bucket body 210', and its top side is preferably formed to be inclined to one side. The top side of the water bucket cover 210" is inclined to one side as described above, water drops formed on or dropping to the top side of the water bucket cover 210" is allowed to flow down to the one side.

The water supply holes 214 formed on the water bucket 210 are selectively opened and closed by an opening and closing means 350. That is, the water supply holes 214 are automatically opened by the opening and closing means 350 when the water bucket 210 is installed to the ice-making case 202, while the water supply holes 214 are automatically closed by the opening and closing means 350 when the water bucket 210 is separated from the ice-making case 202.

The opening and closing means 350 includes the interference lever 222 formed to protrude inwardly from the ice-making case 202, and the opening and closing lever 212 selectively opening the water supply holes 214 (see FIG. 23). The opening and closing lever 212 is formed integrally with the water bucket 210, wherein one end thereof is selectively contacted with the interference lever 222 and the other ends thereof selectively opens the water supply holes 214.

More specifically, a lever supporting wall 210 extending downwardly is formed on the rear end of the water bucket 210, and the opening and closing lever 212 is formed integrally with the lever supporting wall 210. Furthermore, the interference lever 222 is formed to inwardly (rightward in FIG. 23) protrude from the central portion of the rear wall of the ice-making case 202 and is selectively contacted with the one end of the opening and closing lever 212. That is, when the water bucket 210 is installed to the ice-making case 202, the opening and closing lever 212 and the interference lever 222 are brought into contact with each other.

The opening and closing lever 212 includes a lever body 352 formed integrally with the water bucket 210, a contact rib 354 formed to forwardly (rightward in FIG. 23) extend from the central portion of the lever body 352, opening and closing ribs 360 formed to forwardly (rightward in FIG. 23) extend from the left and right side ends of the lever body 352, and opening and closing plugs 362 for selectively closing the water supply holes 214.

Specifically, the rear end (the left end in FIG. 23) of the lever body 352 is formed integrally with the rear wall of the water bucket 210. In addition, the contact rib 354 is formed to extend forward from the lever body 352, and the front end (the right end in FIG. 23) of the contact rib 354 is selectively contacted with the interference lever 222. That is, when the water bucket 210 is installed, the contact rib 354 and the interference lever 222 are brought into contact with each other as shown in FIG. 23.

Meanwhile, each of the opening and closing ribs 360 is also formed to extend forward, and a front end thereof is bent upwardly. Hence, the bent portion of the front end is inserted vertically into the water supply hole 214 therethrough. Furthermore, each opening and closing plug 362 is formed in the shape of a circular plate and is formed integrally with the upper end of the bent portion of the front end of the opening and closing rib 360. Hence, the opening and closing plug 362 having a circular plate shape selectively closes the water supply hole 214.

The interference lever 222 includes a lever supporting part 370 formed to forwardly (rightward in FIG. 23) extend from the ice-making case 202, and a lever head 372 formed on the front end (the right end in FIG. 23) of the lever supporting part 370 and selectively contacted with the end of the contact rib 354. The lever head 372 has the shape of a circular plate having a predetermined size as illustrated and is formed to protrude upwardly from the end of the lever supporting part 370.

Figure 25:
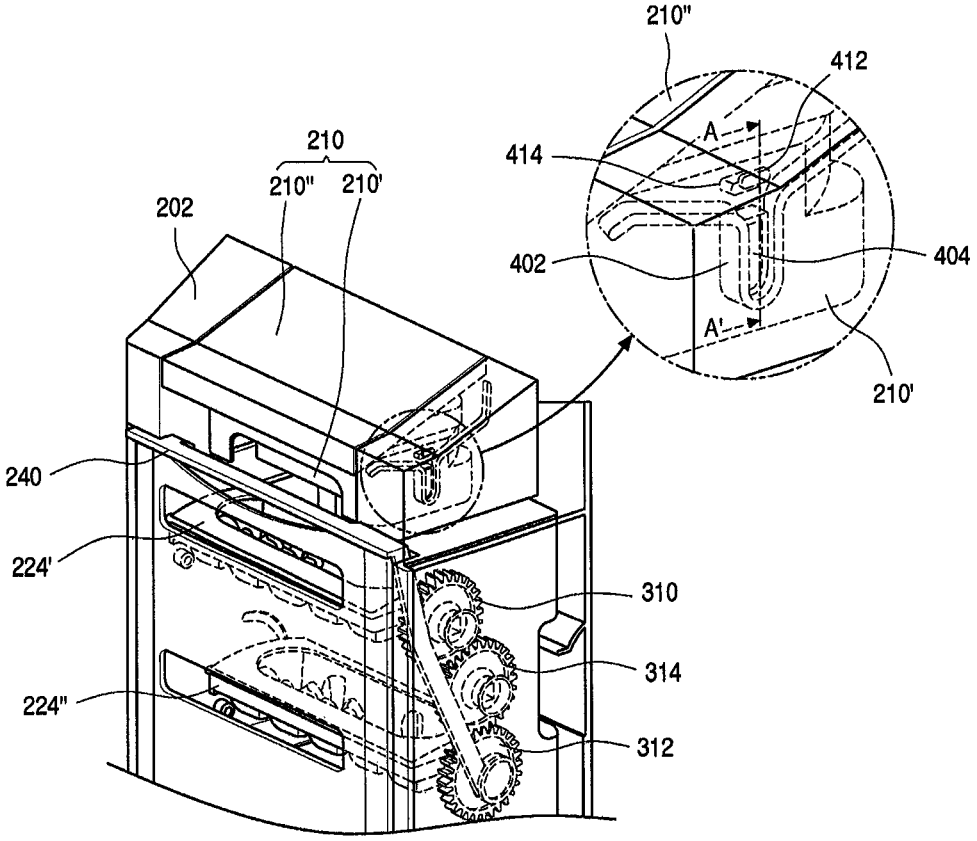
FIG. 25 is a partial rear perspective view illustrating a mounting state of the water bucket of the first embodiment of the present invention.
Figure 26:
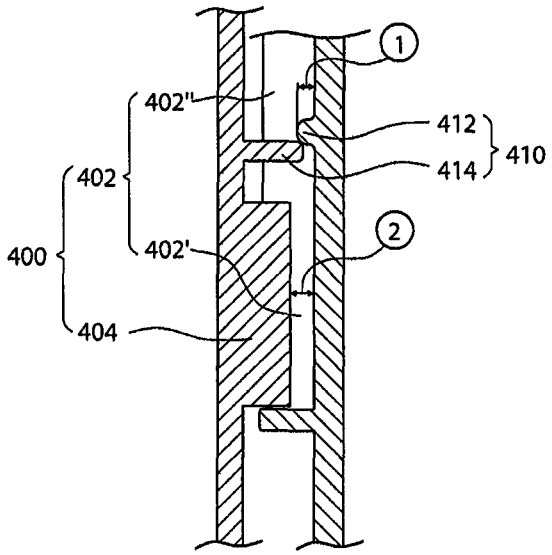
FIG. 26 is a sectional view taken along line A-A' of FIG. 25.
Figure 27:
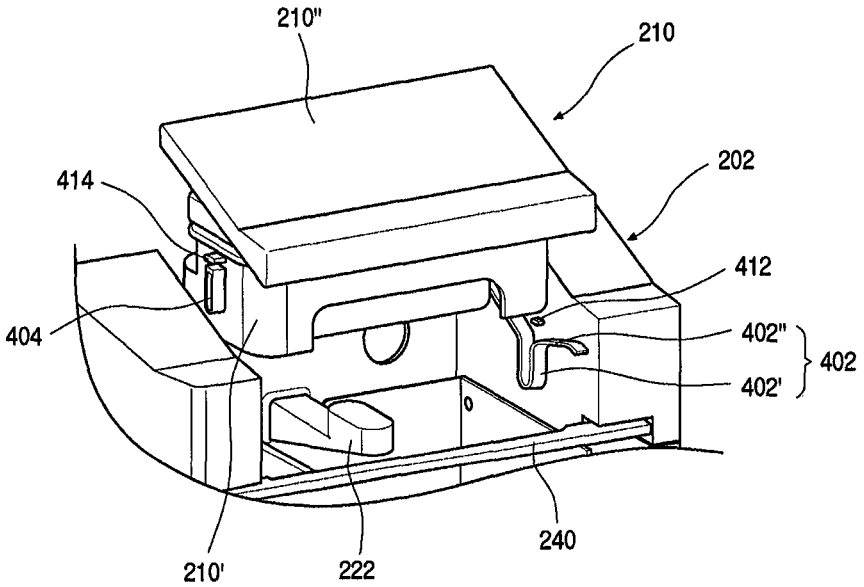
FIG. 27 is a partial exploded perspective view illustrating a state where the water bucket of the first embodiment of the present invention is separated from the ice-making case.

FIGS. 25 to 27 illustrate an installation state of the water bucket 210 in more detail. That is, FIG. 25 illustrates an installation state of the water bucket 210, and FIG. 26 is a sectional view taken along line A-A' of FIG. 27. In addition, FIG. 27 shows that the water bucket 210 is separated from the ice-making case 202.

As shown in the figures, the water bucket 210 is installed to the upper end of the ice-making case 202 and is thus fixed thereto not to be separated. Hence, the ice-making assembly 200 is further provided with an installation guide means 400 for guiding the water bucket 210 to be readily placed on the ice-making case 202 and a separation preventing means 410 for preventing the water bucket 210 installed in the ice-making case 202 from escaping.

The installation guide means 400 includes installation guides 402 and guide protrusions 404 that are respectively formed on the ice-making case 202 and the water bucket 210 in correspondence to each other, thereby being coupled to each other. That is, the installation guides 402 protruding inwardly are integrally formed on the inner side walls of the ice-making case 202, and the guide protrusions 404 protruding laterally are integrally formed on the outer sides of the water bucket body 210' of the water bucket 210.

The installation guide 402 includes a protrusion receiving part 402', which the guide protrusion 404 is inserted into and received in, and a protrusion guide part 402", which guides the guide protrusion 404 to the protrusion receiving part 402'.

The protrusion receiving part 402' is formed in the shape of 'U' as illustrated, and the protrusion guide part 402" is integrally formed to extend on the upper end of the protrusion receiving part 402'. The protrusion guide part 402" has the shape of 'V' in which the distance between both ends is gradually increased as it goes upward. Hence, the installation guide 402 has a generally combined shape of 'U' and 'V'.

Meanwhile, the guide protrusion 404 is formed such that the top-to-bottom height thereof is relatively larger than the left-to-right width and the bottom thereof is formed round. That is, as shown in the figure, the lower end of the guide protrusion 404 is formed in the shape of a semicircle with the central portion protruding downward.

Hence, in a case where the water bucket 210 is installed to the ice-making case 202 from above, the bottom surface of the guide protrusion 404 slides on the protrusion guide part 402" and is guided to the protrusion receiving part 402'.

The separation preventing means 410 includes separation preventing projections 412 and catching ribs 414 that are respectively formed on the ice-making case 202 and the water bucket 210 to have shapes corresponding to each other and interfere with each other.

The separation preventing projections 412 are formed to protrude inwardly from the inner side walls of the ice-making case 202, and the catching ribs 414 are formed to protrude outwardly from the outer side walls of the water bucket 210. In addition, the ends of the separation preventing projections 412 and the catching ribs 414 are formed streamlined to have a rounded curvature.

More specifically with reference to FIG. 26, the separation preventing projection 412 is formed such that projection height ① thereof is smaller than inward projection height of the installation guide 402, and is also smaller than distance ② between the inner side wall of the ice-making case 202 and the guide protrusion 404 in a case where the water bucket 210 is installed.

Such limitation of the lateral projection height of the separation preventing projection 412 is to cause the separation preventing projection 412 not to obstruct the attachment and detachment of the water bucket 210. That is, the limitation of the lateral projection height of the separation preventing projection 412 is to cause the guide protrusion 404 and the separation preventing projection 412 not to interfere with each other when the water bucket 210 is attached or detached.

Meanwhile, as shown in FIG. 27, the separation preventing projection 412 and the catching rib 414 are formed such that their distal ends are brought into partial contact with each other. Hence, if a vertical force of a certain magnitude or more is exerted on the water bucket 210, the catching ribs 414 move above and below the separation preventing projections 412.

More specifically, FIG. 25 illustrates a state where the water bucket 210 is installed to the ice-making case 202. At this time, because the catching ribs 414 interfere with the separation preventing projections 412 and are positioned below the separation preventing projections 412, the water bucket 210 is prevented from escaping upward.

That is, since the interference lever 222 pushes up the opening and closing lever 212 when the water bucket 210 is installed to the ice-making case 202, the water bucket 210 tends to be separated upwardly. Nevertheless, because the catching ribs 414 are positioned below the separation preventing ribs 412, the water bucket 210 is prevented from escaping upward.

However, since the locking force due to the interference between the catching ribs 414 and the separation preventing projections 412 is not large, if the user pulls up the water bucket 210, the catching ribs 414 are partially bent and slide on the separation preventing projections 412 to thereby move above the separation preventing projection 412. Accordingly, the water bucket 210 is separated from the ice-making case 202.

On the contrary, if the water bucket 210 is pushed down, the catching ribs 414 positioned above the separation preventing projections 412 are bent and slide on the ends of the separation preventing projection 412 to thereby move below the separation preventing projections 412, which is a state as shown in FIG. 26.

As such, the separation preventing means 410 including the catching ribs 414 and the separation preventing projections 412 is configured so that its function can not be performed when a force of a certain magnitude or more is applied. That is, it is preferred that the separation preventing means 410 is configured to lose its function when a force larger than the force, with which the interference lever 222 pushes up the opening and closing lever 212, is applied.

It is exemplarily that

The separation preventing projections 412 and the installation guides 402 are integrally formed on the ice-making case 202 and the catching ribs 414 and the guide protrusions 404 are integrally formed on the water bucket 210 as described in the aforementioned embodiment, and vice versa. That is, it is possible that the separation preventing projections 412 and the installation guides 402 are integrally formed on the water bucket 210, and the catching ribs 414 and the guide protrusions 404 are integrally formed on the ice-making case 202.

Hereinafter, a process of supplying water to the ice-making assembly 200 from the outside and a process of delivering water to the ice tray will be described.

The ice-making assembly 200 should be supplied with water from the outside. At this time, the water bucket 210 is drawn out to the outside after opening the freezing chamber door 100 and then opening the upper end of the ice-making case 202.

That is, if the user grips the water bucket 210 and then pulls up the water bucket 210 by a force of a certain magnitude, the catching ribs 414 positioned below the separation preventing projections 412 as shown in FIG. 25 are bent and moved above the separation preventing projections 412, so that the water bucket 210 is separated from the ice-making case 202.

Thereafter, water is poured into the water bucket 210 divided into two parts, and then, the water bucket 210 containing water therein is positioned again in its original location in the ice-making assembly 200.

At this time, if the water bucket 210 is positioned in its original location, the opening and closing lever 212 is moved up by the interference lever 222. If the opening and closing lever 212 is moved up as described above, the water supply holes 214 are opened, so that the water in the water bucket 210 drops downwardly.

More specifically, if the water bucket 210 is separated from the ice-making case 202, the opening and closing plugs 362 close the water supply holes 214. Thus, in the aforementioned state, the water is poured into the water bucket 210 and is stored therein.

Next, the water bucket 210 is installed to the upper end of the ice-making case 202 in a state where water is stored in the water bucket 210. At this time, the water bucket 210 is guided by the installation guide means 400.

More specifically, if the water bucket 210 is lowered from above the ice-making case 202 as shown in FIG. 25, the lower ends of the guide protrusions 404 are brought into contact with the protrusion guide parts 402" of the installation guides 402 and slide thereon to move to the central portion thereof, and then the guide protrusions 404 are smoothly inserted into and received in the protrusion receiving parts 402'.

Simultaneously, the catching ribs 414 interfere with the separation preventing projections 412, wherein the catching ribs 414 are bent by the load of the water bucket 210 and the downward force exerted by the user to thereby move below the separation preventing projections 412, which is a state as shown in FIG. 26.

Then, the installation of the water bucket 210 is completed, and the water bucket 210 is fixed without escaping upwardly again.

When the water bucket 210 is installed to the ice-making case 202 through the aforementioned process, the water supply holes 214 are opened. That is, when the water bucket 210 is installed, the contact rib 354 of the opening and closing lever 212 is brought into contact with the lever head 372 of the interference lever 222.

Accordingly, the interference lever 222 lifts up the front end of the opening and closing lever 212, i.e., the front end (the right end in FIG. 24) of the contact rib 354. Then, the front ends (the right end in FIG. 24) of the opening and closing ribs 360 formed integrally with the contact rib 354 are simultaneously bent upwardly. That is, the opening and closing lever 212 is formed to extend in the fore and aft direction to have elasticity, so that when the front ends thereof are pushed up, they are bent and moved up with respect to the rear end thereof.

As such, if the front ends of the opening and closing ribs 360 are moved up, the opening and closing plugs 362 that have closed the water supply holes 214 are moved up, thereby opening the water supply holes 214. Then, the water in the water bucket 210 drops through the water supply holes 214 and is supplied to the ice trays 224.

Furthermore, the upper tray 224' and the lower tray 224" are filled with the water dropping from the water bucket 210. If the water bucket 210 is supplied with water as described above, the water in the water bucket 210 automatically drops into the ice trays 224.

After supplying water to the ice-making assembly 200 from the outside as described above, the user closes the freezing chamber door 100. Then, the water contained in the ice trays 224 are frozen by means of cold air in the freezing chamber to thereby make ice.

If the water in the ice trays 224 is frozen and ice is made, the user opens the freezing chamber door 100 again and pulls down the ice-separating lever 240. Accordingly, the ice trays 224 are rotated while being twisted, and at this time, pieces of ice contained therein drop into the ice bank 230.

MODE FOR INVENTION

Hereinafter, a second embodiment of the present invention will be described in detail with reference to the drawings.

Figure 28:
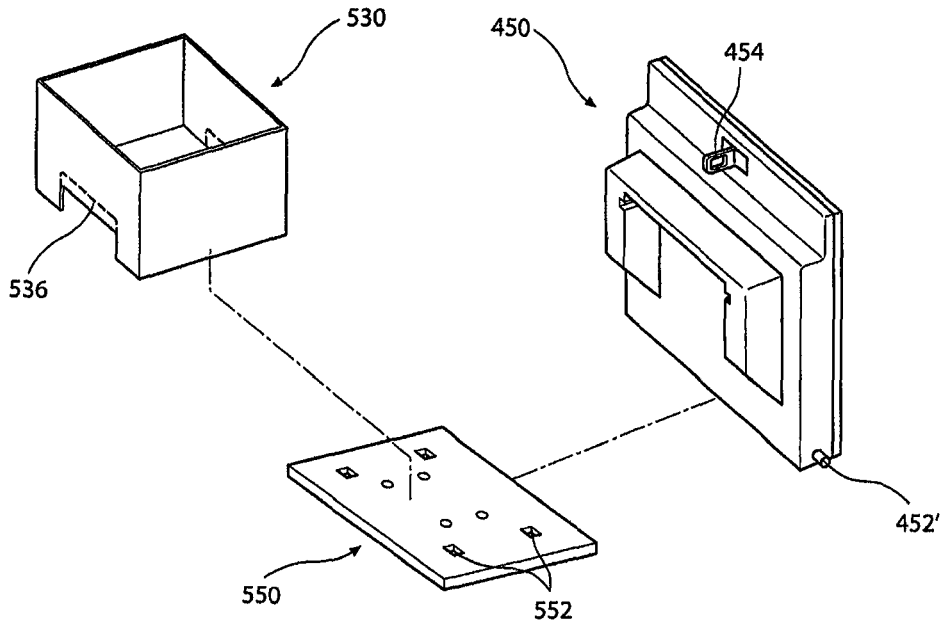
FIG. 28 is an exploded perspective view illustrating a home-bar door and an ice bank of a second embodiment of the present invention.
Figure 29:
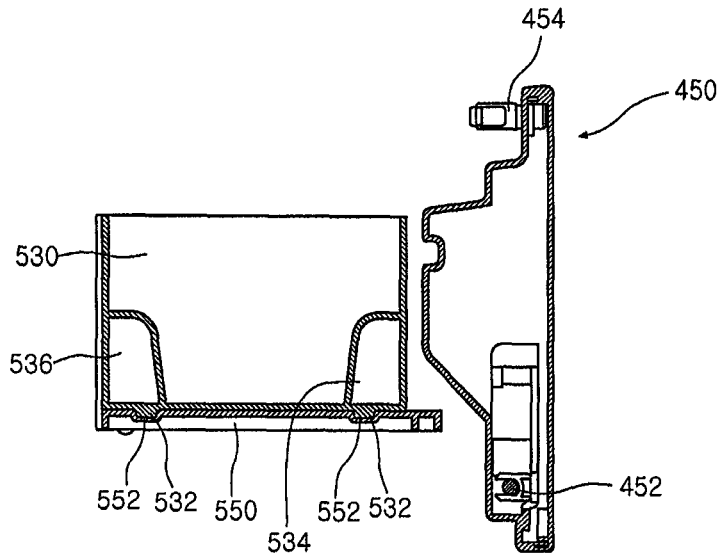
FIG. 29 is a side sectional view illustrating an installation state of the home-bar door and the ice bank of the second embodiment of the present invention.

FIGS. 28 and 29 specifically show that the home-bar door 450 and the ice bank 530 are connected to each other. That is, FIG. 28 is an exploded perspective view illustrating a detailed configuration of the home-bar door 450 and the ice bank 530, and FIG. 29 is a side sectional view of the home-bar door 450 and the ice bank 530.

As shown in the figures, the ice bank 530 is formed in the shape of a quadrangular box with an upper part opened.

In addition, a plurality of locking protrusions 532 protruding downwardly are formed on the bottom surface of the ice bank 530. The locking protrusions 532 are received in locking recesses 552 of a bank supporting plate 550, which will be described below, and forcibly cause the ice bank 530 to move forward and rearward while it is placed on the bank supporting plate 550.

Meanwhile, bank pulls 534 and 536 are respectively formed on the front and rear (the left and right sides in FIGS. 28 and 29) of the lower ends of the ice bank 530. That is, the front pull 534 is formed on the front end (the right end in FIGS. 28 and 29) of the ice bank 530, and the rear pull 536 is formed on the rear end (the left end in FIGS. 28 and 29) of the ice bank 530. The front and rear pulls 534 and 536 are parts that enable the user to catch for drawing out the ice bank 530 forward and rearward (leftward and rightward in FIGS. 28 and 29).

The bank supporting plate 550 that can slide forward and rearward is provided below the ice bank 530. That is, the bank supporting plate 550 is to support the ice bank 530 and is installed to the floor surface of the ice-making case 502.

The plurality of locking recesses 558 downwardly depressed are formed on the top side of the bank supporting plate 550. The locking recesses 558 are parts that receive the locking protrusions 532 of the bottom surface of the ice bank 530 and are coupled thereto. Thus, it is preferred that the locking recesses 558 and the locking protrusions 532 are formed to correspond in number, position and shape to each other.

Hinge protrusions 452' that are the center of rotation of the home-bar door 450 are formed to protrude outwardly on both sides of the lower end of the home-bar door 420.

Figure 30:
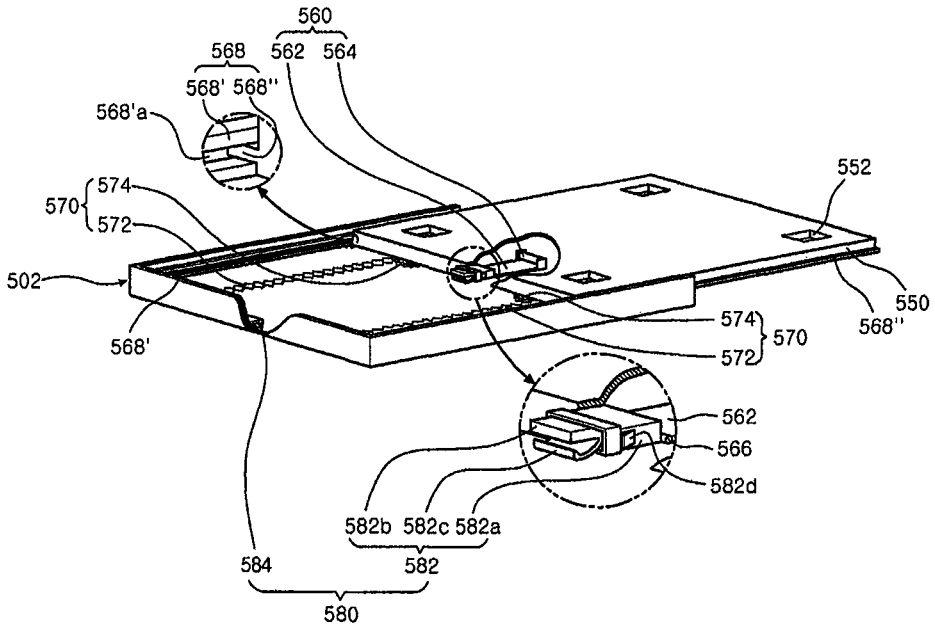
FIG. 30 is a rear perspective view illustrating an installation state of a bank supporting plate of the second embodiment of the present invention.

FIG. 30 illustrates in detail a device for enabling the bank supporting plate 550 to slide from the ice-making case 502 in a one-touch manner and to be selectively drawn out forward.

As shown in the figure, the bank supporting plate 550 is drawn out forward (rearward in FIG. 30) by a movement enforcement means 560. That is, the movement enforcement means 560 forcibly causes the bank supporting plate 550 to move forward (rearward in FIG. 30).

The movement enforcement means 560 includes a scroll spring 562 and a spring roll 564 around which the scroll spring is wounded. The spring roll 564 is installed to the front end (the rear end in FIG. 30) of the floor surface of the ice-making case 502. Furthermore, the rear end (the front end in FIG. 30) of the scroll spring 562 is fixedly connected to a locking end 566 provided on the rear end (the front end in FIG. 30) of the bank supporting plate 550. Hence, the bank supporting plate 550 is always caused to move forward (rearward in FIG. 30) by a restoring force of the scroll spring 562.

Meanwhile, the ice-making chamber 520 further includes a guide means 568 for guiding the bank supporting plate 550 to smoothly move within the ice-making case 502.

The guide means 568 includes sliding guides 568' formed to extend in the fore and aft direction on the lateral sides of the lower end of the ice-making case 502, and sliding protrusions 568" formed to protrude laterally from the lateral sides of the bank supporting plate 550.

The sliding guide 568' is formed to have a '⊏'-shaped cross section as illustrated. Hence, the sliding protrusions 568" are inserted into sliding recesses 568'*a* formed in the sliding guides and slide forward and rearward.

A damping means 570 is further installed to the ice-making chamber 520. The damping means 570 is to control the drawing-out velocity of the bank supporting plate 550 when the bank supporting plate 550 is drawn out forward by the movement enforcement means 560. That is, the damping means serves to decelerate the drawing-out velocity of the bank supporting plate 550 when the bank supporting plate 550 is drawn out in front of a refrigerator by means of a restoring force of the scroll spring 562.

The damping means 570 includes racks and pinions that are respectively formed on the ice-making case 502 and the bank supporting plate 550 to correspond to each other and are meshed with each other. That is, the damping means 570 includes the damping racks 572 that are formed in a pair on the left and right sides of the floor surface of the ice-making case 502 and the damping pinions 574 that are respectively formed on the left and right sides of the bottom surface of the bank supporting plate 550.

The damping rack 572 and the damping pinion 574 are formed with gear teeth corresponding to each other, thereby being meshed with each other. Hence, the damping pinions 574 move along the damping racks 572 and decelerate the moving velocity of the bank supporting plate 550. The rotational velocity of the damping pinions 574 is generally controlled by means of hydraulic pressure, wherein the control of the rotational velocity of a pinion by means of hydraulic pressure is often applied to a drawing-out device of a cup holder for a motor vehicle, and thus, the detailed description thereabout will be omitted.

The bank supporting plate 550 is fixed in the ice-making chamber 520 by means of a locking means 580. That is, the bank supporting plate 550 tends to be drawn out forward by the scroll spring 562, so that there is further provided the locking means 580 for selectively locking the bank supporting plate 550 to the rear end of the ice-making case 502.

The locking means 580 includes a button assembly 582 and a button hook 584 that are respectively formed on the ice-making case 502 and the bank supporting plate 550 in correspondence to each other and are selectively coupled to each other. The button assembly 582 and the button hook 584 are configured such that they are repeatedly coupled and released sequentially by an external force exerted from one side of the bank supporting plate 550. That is, if the user pushes the front end (the rear end in FIG. 30) of the bank supporting plate 550 from the front (the rear in FIG. 30) thereof by hand, the button assembly 582 and the button hook 584 are coupled to each other. In this state, if the user pushes the bank supporting plate 550 rearward again, the button assembly 582 and the button hook 584 are released.

The button assembly 582 includes a button case 582*a* defining an external appearance as illustrated, a button body 582*b* sliding within the button case 582*a* forward and rearward, and a coupling hook 582*c* formed integrally with the button body 582*b* and having an end selectively coupled to the button hook 584.

The button assembly 582 is installed to the central portion of the rear end (the front end in FIG. 30) of the bank supporting plate 550. The button case 582*a* is formed in the shape of a quadrangular box with a front part (FIG. 30) opened, and the button body 582*b* and the coupling hook 582*c* are selectively received in the button case 582*a*. In addition, locking protrusions 582*d* for allowing the button assembly 582 to be easily coupled to the bank supporting plate 550 are formed to protrude laterally on both sides of the button case 582*a*.

The button body 582*b* and coupling hook 582*c* are formed to have a '7' -shaped right cross section (FIG. 30). That is, the rear end of the coupling hook 582*c* is formed integrally with the rear end of the button body 582*b*, and the front end thereof is formed to be downwardly spaced apart from the front end of the button body 582*b* by a certain distance. Furthermore, the coupling hook 582*c* is configured such that its front end can be moved vertically by elastic force due to its own shape. The front end (FIG. 30) of the coupling hook 582*c* protrudes upward and is formed in an approximately ⌐ shape when viewed from a side.

The button hook 584 is integrally formed to protrude forwardly from the lower end of the rear wall (FIG. 30) of the ice-making case 502, and the front end thereof protrudes downwardly again, thereby having a hook shape. That is, the button hook 584 is formed in ‹¬, shape (as viewed from the right side in FIG. 30). Hence, the button hook is selectively coupled to the coupling hook 582*c* corresponding thereto.

Since the button body 582*b* and the coupling hook 582*c* are integrally formed, they simultaneously move in and out of the button case 582*a*. Furthermore, in a case where the button body 582*b* and the coupling hook 582*c* are received in the button case 582*a*, the coupling hook 582*c* is pushed by the lower end of the button case 582*a* to be moved upwardly, so that the button hook 584 is coupled to the button assembly 582. Moreover, in a case where the button body 582*a* and the coupling hook 582*c* come out of the button case 582*a*, a gap between the coupling hook 582*c* and the button body 582*b* is widened, so that the coupling hook 582*c* and the button hook 584 are released from each other.

Meanwhile, when the user pushes the bank supporting plate 550 rearward, the button body 582*b* strikes the rear wall of the lower end of the ice-making case 502. Then, when the button body strikes the rear wall for the first time, the button body 582*b* and the coupling hook 582*c* are received in the button case 582*a* and are maintained in such a state. At this state, if the button body 582*b* strikes again the rear wall of the ice-making case 502 by external force, the button body 582*b* and the coupling hook 582*c* are drawn out to the outside of the button case 582*a*.

Hence, a locker pin (590 in FIG. 31) for selectively fixing the button body 582*b* is further provided within the button body 582*b* and the button case 582*a*. That is, the button body 582*b* always tends to come out of the button case 582*a* by means of a spring (not shown) that is provided in the button assembly 582, but the locker pin 590 fixes the button body 582*b*.

Figure 31:
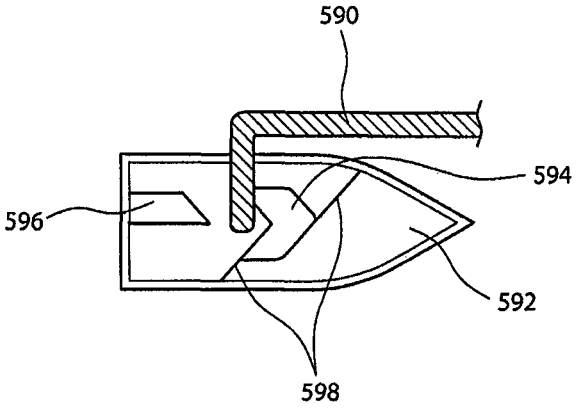
FIG. 31 is a top view partially illustrating an inside of a button assembly of the second embodiment of the present invention.

Since the aforementioned button assembly 582 is also employed in a cup holder for a motor vehicle, the schematic description thereabout will be made with reference to FIG. 31 hereinafter.

A movement passage 592 as illustrated is formed to be downwardly depressed on the floor surface in the button body 582*b*, and a heart protrusion 594 having a heart shape is formed to protrude upwardly on the central portion of the movement passage 592. Hence, the end of the locker pin 590 moves along the outside of the heart protrusion 594.

In addition, a guide protrusion 596 for guiding the movement of the locker pin 590 is further formed on the left of the heart protrusion 594, and the movement passage 592 is further formed with a plurality of steps 598 for allowing the end of the locker pin 590 to move only in one direction.

Next, a process of drawing out the bank supporting plate 550 and the ice bank 530 in a state where the home-bar door 450 is opened will be described with reference to FIGS. 29 to 32.

Figure 32:
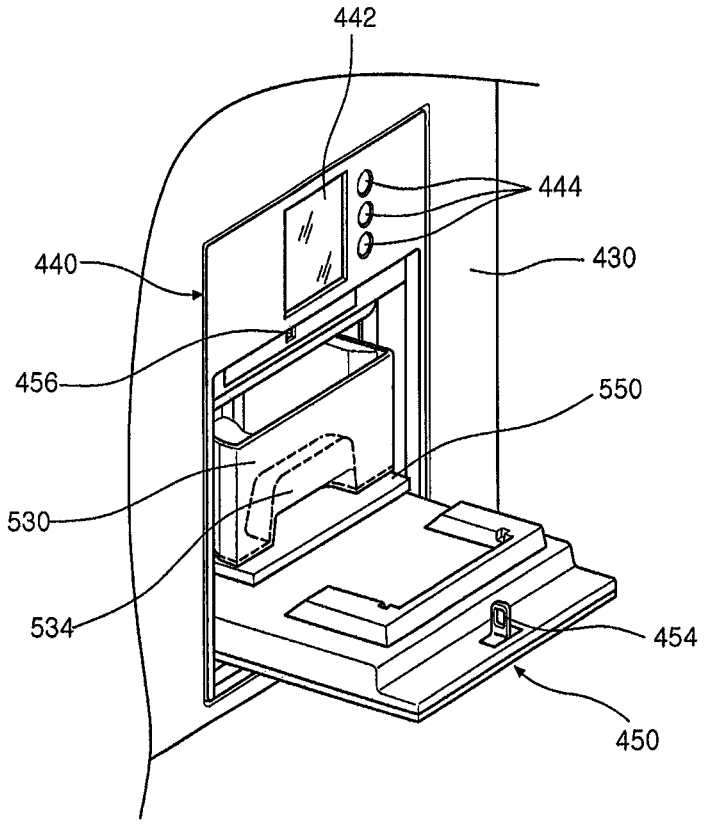
FIG. 32 is a use state view illustrating an opened state of the home-bar door of the second embodiment of the present invention.
Figure 33:
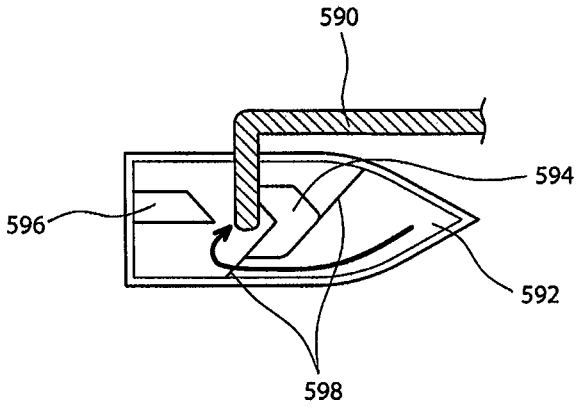
FIG. 33 is a use state view illustrating a movement path of a locker pin when a button body is received in a button case in the second embodiment of the present invention.
Figure 34:
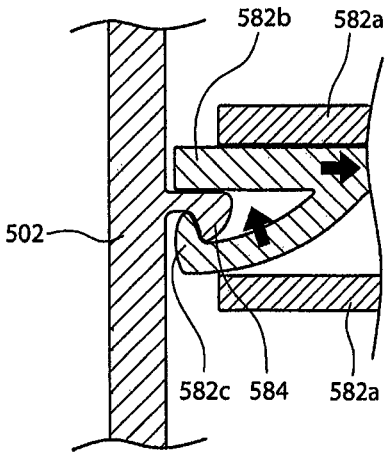
FIG. 34 is a side sectional view illustrating a state where a button hook and a coupling hook of the second embodiment of the present invention are coupled to each other.

In a state where the home-bar door 450 is opened as shown in FIG. 32, the bank supporting plate 550 and the ice bank 530 are inserted in the ice-making chamber 520. Furthermore, at this time, the locker pin 590 is positioned on the left of the heart protrusion 594 as shown in FIG. 33, so that the button body 582*b* and the coupling hook 582*c* are coupled to the button hook 584 while being inserted in the button case 582*a* as shown in FIG. 34. Accordingly, the rear end of the bank supporting plate 550 is fixed to the rear end of the ice-making case 502, and thus, cannot be drawn out forward.

In order to draw out the ice bank 530 forward in the aforementioned state, the front end of the bank supporting plate 550 is pushed rearward. Then, the rear end (the left end in FIG. 34) of the button body 582*b* strikes the rear wall of the ice-making case 502, and in this process, the locker pin 590 is moved to the right of the heart protrusion 594 and is guided by the guide protrusion 596.

Figure 35:
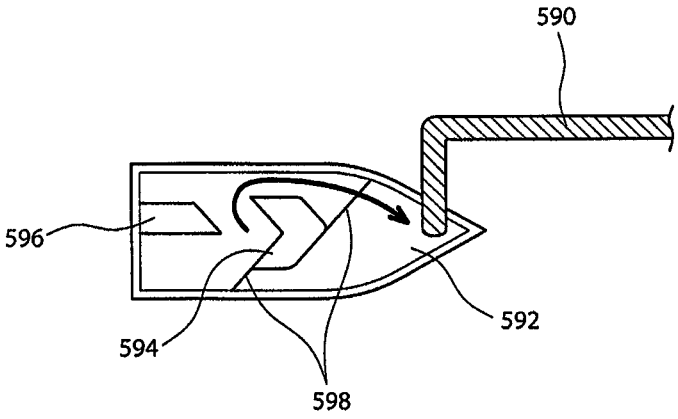
FIG. 35 is a use state view illustrating a movement path of the locker pin when the button body is protruded to the outside of the button case in the second embodiment of the present invention.
Figure 36:
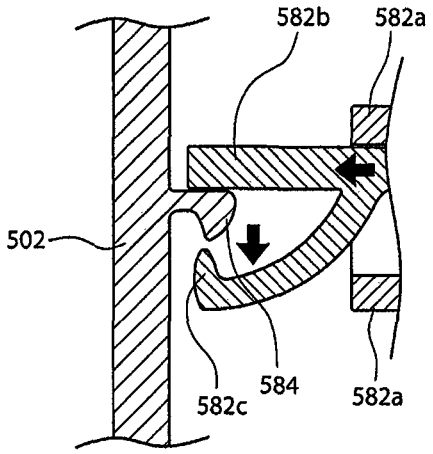
FIG. 36 is a side sectional view illustrating a state where the button hook and the coupling hook of the second embodiment of the present invention are released from each other.

At this time, if the user releases the force of pushing the bank supporting plate 550, the button body 582*b* is moved to the left (FIG. 35) by a force of a spring (not shown) provided in the button assembly 582, whereby the locker pin 590 is moved along the edge of the heart protrusion 594 as illustrated by an arrow in FIG. 35.

If the locker pin 590 is moved to the right of the heart protrusion 594 and positioned in the right end of the movement passage 592, the button body 582*b* and the coupling hook 582*c* come out of the button case 582*a*. Hence, the right end of the coupling hook 582*c* is lowered by its own elasticity, so that the coupling hook 582*c* and the button hook 584 are released from each other.

If the button assembly 582 and the button hook 584 are released from each other as described above, the bank supporting plate 550 is drawn out forward by a force of a movement enforcement means 560. Furthermore, at this time, the damping means 570 adjusts the forward drawing-out velocity of the bank supporting plate 550 and enables the bank supporting plate 550 to be smoothly drawn out forward.

When the bank supporting plate 550 is drawn out forward as described above, the ice bank 530 positioned on the bank supporting plate 550 is also drawn out forward. Hence, the user can take out the ice in the ice bank 530 and use the same.

Furthermore, a process of pushing in the bank supporting plate 550 is performed in reverse order of the aforementioned drawing-out process. That is, in a state where the ice bank 530 is placed on the bank supporting plate 550, the front end of the bank supporting plate 550 is pushed rearward.

Then, the bank supporting plate 550 is guided rearward by means of the sliding guides 568', and consequently, the button body 582*b* strikes the rear wall of the ice-making case 502. Then, the button body 582*b* is introduced into the button case 582*a* in a state as shown in FIG. 29.

If the button body 582*b* is introduced into the button case 582*a*, the locker pin 590 is moved from the left to the right of the heart protrusion 594 as illustrated by an arrow in FIG. 33 and then stops. Then, the button hook 584 and the coupling hook 582*c* are coupled to each other as shown in FIG. 34, so that the bank supporting plate 550 is fixed.

Hereinafter, a third embodiment of the present invention will be described with reference to the drawings.

Figure 37:
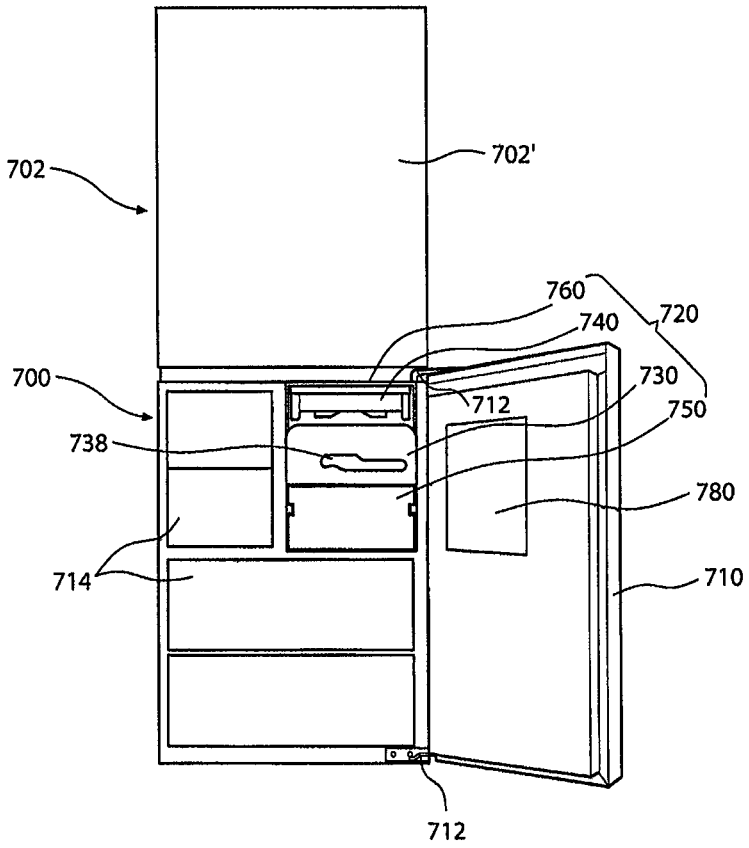
FIG. 37 is a front view illustrating an open state of a freezing chamber door in a third embodiment of the present invention.
Figure 38:
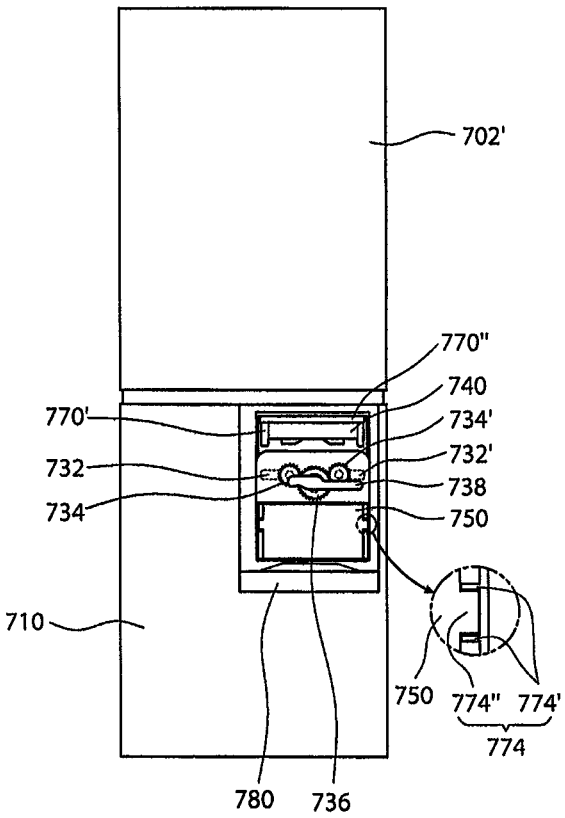
FIG. 38 is a front view of a refrigerator showing an open state of a home-bar door of the third embodiment of the present invention.
Figure 39:
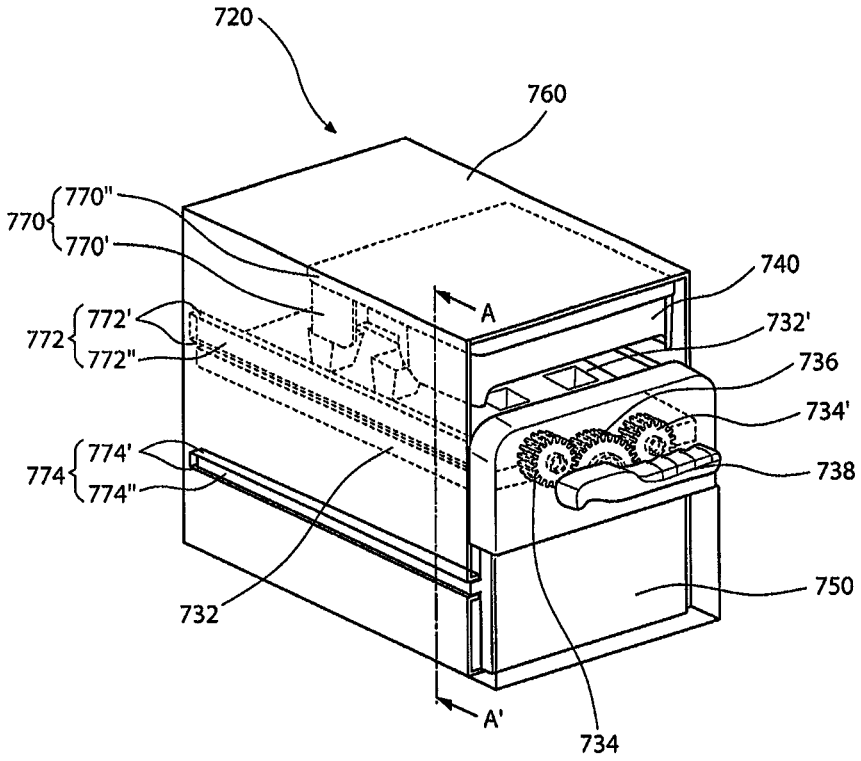
FIG. 39 is a perspective view illustrating an ice-making chamber of the third embodiment of the present invention.
Figure 40:
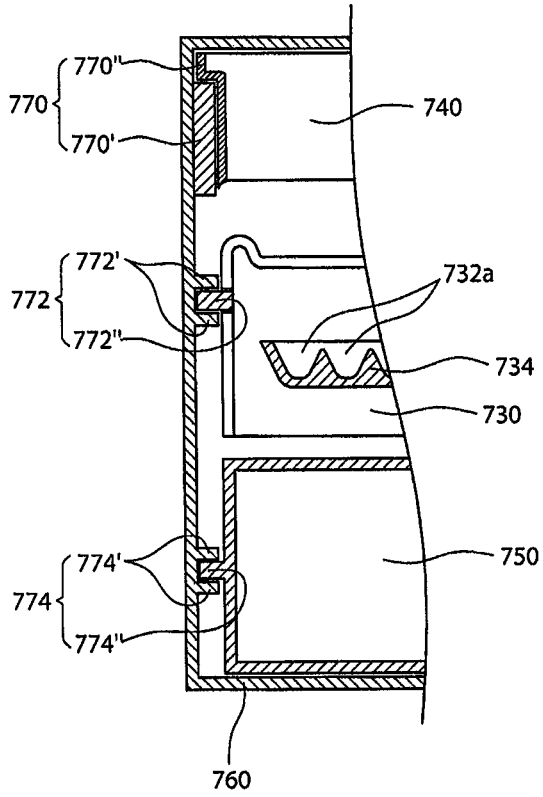
FIG. 40 is a sectional view taken along line A-A' of FIG. 39.

FIG. 37 is a front view of a refrigerator according to the present invention illustrating a state where a freezing chamber door is opened, and FIG. 38 illustrates a state where a home-bar door of this embodiment of the present invention is opened. In addition, FIG. 39 is a perspective view illustrating an ice-making chamber of the embodiment of the present invention, and FIG. 40 is a sectional view taken along line A-A' of FIG. 39.

As shown in the figures, a refrigerator generally includes a freezing chamber 700 and a refrigerating chamber 702. In the present invention, the refrigerator in which the refrigerating chamber 702 is formed on the upper portion thereof and the freezing chamber 700 is formed on the lower portion thereof will be exemplarily described.

The freezing chamber 700, which is to store goods in an inner storage space in a frozen state, is configured such that and the front side thereof is selectively opened and closed by a freezing chamber door 710. That is, door hinges 712 are provided on upper and lower portions of the right end of the freezing chamber 700, thereby being the center of rotation of the freezing chamber door 710.

The refrigerating chamber 702 is formed above the freezing chamber 700 and serves to store goods in an inner storage space in a refrigerated state. In addition, the front side of the refrigerating chamber 702 is selectively opened and closed by a refrigerating chamber door 702'.

A plurality of receiving cases 714 storing food is provided in the freezing chamber 700. The receiving case 714 can be configured in various forms and is installed to be drawn out forward in a sliding manner.

An ice-making chamber 720 is formed in the right upper end of the freezing chamber 700. The ice-making chamber 720 is formed in the shape of a quadrangular box with a front side is opened. Hence, the front side of the ice-making chamber 720 is selectively opened and closed by a home-bar door 780, which will be described later.

Individual devices for freezing water into ice and storing the ice are installed in the ice-making chamber 720. More specifically, the ice-making chamber 720 includes an ice maker 730, a water bucket 740 provided above the ice maker 730 to supply water to the ice-making chamber 720, an ice bank 750 provided below the ice-making chamber 720 to receive and store ice supplied from the ice-making chamber 720, and an ice-making case 760 defining an external appearance.

More specifically, the overall external appearance of the ice-making chamber 720 is defined by the ice-making case 760 in the shape of a quadrangular box with a front part opened, and the front side of the ice-making case 760 is selectively closed by the home-bar door 780, which will be described later.

The water bucket 740 is installed to be drawn out forward on the upper end of the ice-making case 760, and the ice maker 730 is installed to be drawn out forward on the central portion of the ice-making case 760. Furthermore, the ice bank 750 is installed to be drawn out forward on the lower end of the ice-making case 760.

The ice maker 730 includes a plurality of ice trays 732 and 732' in which ice is made, a plurality of ice-separating gears 734 and 734' for transmitting rotational force to the ice trays 732 and 732', a driving gear 736 for transmitting rotational force to the ice-separating gears 734 and 734', and an ice-separating lever 738 forcibly causing the supplying gear 736 to rotate.

A plurality of freezing spaces 732*a* for storing and freezing water are formed in the ice trays 732 and 732' in regular lines in the fore and aft direction and the left and right direction, and the ice trays 732 and 732' are respectively formed on the left and right of the central portion of the ice maker 730. That is, the left tray 732 is provided on the relatively left side, and the right tray 732' is installed to the right side to be spaced apart from the left tray by a predetermined distance.

The ice-separating gears 734 and 734' are fixedly installed to the front ends of the plurality of ice trays 732 and 732'. That is, the left ice-separating gear 734 is fixedly installed to the front end of the left tray 732, and the right ice-separating gear 734' is fixedly installed to the front end of the right tray 732'.

The driving gear 736 is installed between the plurality of ice-separating gears 734 and 734'. That is, the driving gear 736 is installed between the left ice-separating gear 734 and the right ice-separating gear 734', and transmits rotational force to the left ice-separating gear 734 and the right ice-separating gear 734' simultaneously.

The ice-separating gears 734 and 734' and the driving gear 736 includes gears to transmit the rotational force to each other. That is, the ice-separating gears 734 and 734' and the driving gear 736 respectively have gear teeth corresponding in shape to each other formed on their circumference surfaces to be thereby meshed with each other. Thus, if the driving gear 736 rotates, the plurality of ice-separating gears 734 and 734' meshed therewith also rotate.

The ice-separating lever 738 is formed to extend in the left and right direction and is coupled to the coupling gear 736. That is, the ice-separating lever 738 is fixedly installed to the front end of the driving gear 736 and is formed to extend in the left and right direction. Furthermore, the ice-separating lever 738 is rotatably installed. Hence, if a user lowers the right end of the ice-separating lever 738, the ice-separating lever 738 rotates clockwise.

Meanwhile, the front side of the ice maker 730 is formed of a transparent material. Hence, if the user opens the home-bar door 780, which will be described later, it is possible to view the inside of the ice maker 730 through the front side of the ice maker 730. Accordingly, the user can immediately check whether water contained in the ice trays 732 and 732' of the ice maker 730 is frozen.

Furthermore, the water bucket 740, the ice maker 730 and the ice bank 750 in the ice-making chamber 720 are installed such that they can slide and be drawn out forward. Hence, the ice-making chamber 720 is provided with a plurality of guide means.

More specifically, there are provided a water bucket guide means 710 for guiding the forward drawing-out of the water bucket 740, an ice maker guide means 712 for guiding the forward drawing-out of the ice maker 730, and a bank guide means 714 for guiding the forward drawing-out of the ice bank 750.

The water bucket guide means 710 includes water bucket guides 710' formed on inner side walls of the ice-making case 760, and a water bucket edge 710" formed on the upper end of the water bucket 740.

The water guides 710' are formed to protrude inwardly from the inner side walls of the ice-making case 760 and to extend in the fore and aft direction. Furthermore, the water bucket edge 710" is formed to protrude outwardly from the upper end of the water bucket 740 by a predetermined distance, and the left and right sides of the water bucket edge 710" are placed on the upper ends of the water bucket guides 710' and slide thereon forward and rearward.

The ice maker guide means 712 includes ice maker guides 712' formed to protrude inwardly from the inner walls of the ice-making case 760 and ice maker protrusions 712" formed to protrude laterally from the left and right sides of the ice maker 730.

The ice maker guides 712' are formed in pairs on the upper and lower portions, and a predetermined gap is formed between the upper and lower ice maker guides 712'. Each ice maker protrusion 712" is inserted and received between the upper and lower ice maker guides 712' and slides forward and rearward. The ice maker protrusion 712" is formed to extend in the fore and aft direction on the outside of the ice maker 730.

The bank guide means 714 includes bank guides 714' formed to protrude inwardly from the inner walls of the ice-making case 760 and bank protrusions 714" formed to protrude in the left and right direction from the left and right sides of the ice bank 750.

The bank guides 714' are formed in pairs on the upper and lower portions like the ice maker guides 712', and a predetermined gap is formed between the upper and lower bank guides 714'. Each bank protrusion 714" is inserted and received between the upper and lower bank guides 714' and slide forward and rearward. The bank protrusions 714" are formed to extend in the fore and aft direction like the ice maker protrusions 712" and are moved in and out forward and rearward while being guided along the bank guides 714'.

The home-bar door 780 is further installed to the freezing chamber door 710. The home-bar door 780 is a home-bar door exclusively used for the ice-making chamber 720 contrary to a general home-bar door of a refrigerator. That is, a generally used home-bar door of a refrigerator is to draw out a beverage to the outside, whereas the home-bar door 780 of the present invention is a home-bar door exclusively used for the ice-making chamber to open and close the inside of the ice-making chamber 720.

Thus, the home-bar door 780 is installed in a position corresponding to the ice-making chamber 720. That is, as illustrated, the home-bar door is formed on the right upper end of the freezing chamber door 710, which corresponds to the front of the ice-making chamber 720. Furthermore, the home-bar door 780 has a size corresponding to the front side of the ice-making chamber 720. That is, the home-bar door 780 is formed in the shape of a quadrangular flat plate having a size corresponding to the front size of the ice-making case 760.

Meanwhile, although not shown, the lower end of the home-bar door 780 is provided with a home-bar hinge so that the home-bar door 780 can be rotated about its lower end. Furthermore, the upper end of the home-bar door 780 and the main body of the freezing chamber 700 are provided with a coupling hook and a coupling ring which are coupled to each other, so that the upper end of the home-bar door 780 is selectively fixed to the main body of the freezing chamber 700. Because the coupling means of the home-bar door 780 has the same structure as the opening and closing structure of a generally used home-bar door, the detailed description thereabout will be omitted.

Hereinafter, a process of drawing out ice in the ice-making chamber of the refrigerator according to the third embodiment will be described.

In the aforementioned refrigerator, food is stored in the upper refrigerating chamber in a refrigerated state, and food is stored in the lower freezing chamber 700 in a frozen state. Hence, in order to take out food in the freezing chamber 700, the user opens the freezing chamber door 710 by pulling the left end of the freezing chamber door 710 forward as shown in FIG. 37.

Meanwhile, in order to use the ice-making chamber 720, the user opens the home-bar door 780. That is, in a case where the user intends to supply water into the ice-making chamber 720 or to take out ice in the ice-making chamber 720, the user opens the home-bar door 780.

At this time, the home-bar door 780 is opened by rotating it about its lower end as shown in FIG. 38. Then, the user can draw out the water bucket 740 or ice maker 730 and the ice bank 750 forward. Of course, when the water bucket 740 or ice maker 730 and the ice bank 750 are drawn out forward or positioned in their original positions, they are guided forward and rearward by the aforementioned water bucket guide means 710, the ice maker guide means 712 and the bank guide means 714.

Furthermore, the user can check a frozen state of water contained in the ice trays 732 and 732' while the home-bar door 780 is opened. That is, since the front side of the ice maker 730 is formed of a transparent material, the user can view the inside of the ice maker 730 when opening the home-bar door 780, thereby immediately checking whether the ice-making operation in the ice trays 732 and 732' is completed.

Moreover, after checking the completion of the ice-making operation in the ice maker 730, the user separates the ice in the ice trays 732 and 732' by operating the ice-separating lever 738. That is, the user causes the ice frozen in the ice trays 732 and 732' to drop into the ice bank 750.

Figure 41:
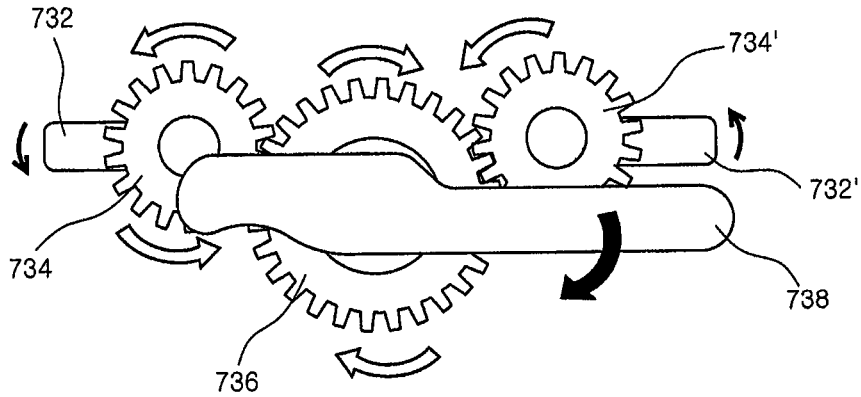
FIG. 41 is a use state view illustrating a rotating state of ice-separating gears of the embodiment of the present invention.

Such a process will be described in more detail with reference to FIG. 41 as follows.

The left tray 732 and the right tray 732' in which ice is made are maintained horizontal. In this state, the user grips the right end of the ice-separating lever 738 by hand and lowers it. Thus, the ice-separating lever 738 rotates clockwise.

When the ice-separating lever 738 rotates clockwise, the driving gear 736 fixed thereto also rotates clockwise. Hence, the ice-separating gears 734 and 734' meshed with the driving gear also rotate mutually. That is, the left ice-separating gear 734 and the right ice-separating gear 734' rotate counterclockwise.

If the left ice-separating gear 734 and the right ice-separating gear 734' respectively rotate as described above, the left tray 732 and the right tray 732' fixed thereto also rotate counterclockwise respectively. In this process, the ice made in the ice trays 732 and 732' is separated and drops into the ice bank 750.

Once the ice in the ice trays 732 and 732' is separated as described above, the ice-separating gears 734 and 734' return to their original locations by a restoring force of a return spring (not shown). That is, the ice-separating gears rotate clockwise again and are thus positioned in their original locations. Then, the driving gear 736 and the ice-separating lever 738 rotate counterclockwise and are positioned in their original locations.

The scope of the present invention is not limited to the aforementioned embodiments. It is possible that those skilled in the art can make various modifications based on the present invention within the scope of the aforementioned techniques.

For example, although it is exemplarily described in the aforementioned embodiment that the two ice-separating gears 734 and 734' are respectively installed to the left and right sides, three or more ice-separating gears 734 and 734' may also be installed. That is, it is also possible that three or more ice-separating gears 734 and 734' are installed and the ice-separating gears 734 and 734' and the driving gear 736 are engaged with each other to simultaneously rotate.

INDUSTRIAL APPLICABILITY

According to the present invention, an ice-making assembly for a refrigerator is easily installed, and the use convenience of a refrigerator is improved because ice is taken out more easily.

The invention claimed is:

1. A refrigerator, comprising:

a freezing chamber;

a freezing chamber door for selectively opening and closing the freezing chamber;

an ice-making assembly provided on a back side of the freezing chamber door, the ice making assembly comprising:

an ice maker to make ice;

an ice bank provided below the ice maker to store ice;

a bank supporting plate on which the ice bank is placed; and an ice-making case in which the ice maker, the ice bank and the bank supporting plate are received, the ice-making case including an opening at a rear side thereof allowing the ice bank to be withdrawn; and a home bar door provided on the freezing chamber door and selectively opened so that a front of the ice bank is exposed to an outside, wherein the ice bank is allowed to be withdrawn forward through the home bar door, and to be withdrawn rearward through the opening of the ice-making case when the freezing chamber door is in an opened position.

2. The refrigerator as claimed in claim 1, wherein pulls to be caught by a user are respectively provided on the front and rear sides of the ice bank.

3. The refrigerator as claimed in claim 1, further comprising a water bucket above the ice maker.

4. The refrigerator as claimed in claim 1, further comprising a connection link connecting the bank supporting plate and the home bar door, such that the bank supporting plate moves forward when the home bar door rotates to be opened.

5. The refrigerator as claimed in claim 4, wherein one end of the connection link is hinged to a front end of the bank supporting plate and the other end of the connection link is rotatably connected and installed to an upper half portion of the home bar door.

6. The refrigerator as claimed in claim 5, further comprising a movement guide formed on the ice-making assembly in a fore and aft direction, for guiding the bank supporting plate to moves forward and rearward.

7. The refrigerator as claimed in claim 1, further comprising a movement enforcement means forcibly causing the bank supporting plate to move forward, and a locking means causing the bank supporting plate to be selectively fixed to a rear end of the ice-making case.

8. The refrigerator as claimed in claim 7, further comprising a damping means provided in one side of the movement enforcement means, for controlling a moving velocity of the bank supporting plate.

9. The refrigerator as claimed in claim 8, wherein the damping means comprises a rack and a pinion respectively formed on the ice-making case and the bank supporting plate in correspondence to each other to be meshed with each other.

10. The refrigerator as claimed in claim 9, wherein the movement enforcement means comprises:

a scroll spring; and a spring roll around which the scroll spring is wound.

11. The refrigerator as claimed in claim 9, wherein the locking means comprises a button assembly and a button hook respectively formed on the ice-making case and the bank supporting plate in correspondence to each other to be selectively coupled to each other.

12. The refrigerator as claimed in claim 11, wherein the button assembly and the button hook are configured so that they are repeatedly coupled and released sequentially by an external force applied from one side of the bank supporting plate.

13. The refrigerator as claimed in claim 12, wherein the button assembly comprises:

a button case defining an external appearance thereof;

a button body sliding within the button case forward and rearward; and a coupling hook formed integrally with the button body and having an end selectively coupled to the button hook.

* * * * *